US006199524B1

(12) United States Patent
Ushida

(10) Patent No.: US 6,199,524 B1
(45) Date of Patent: Mar. 13, 2001

(54) CONTROL APPARATUS FOR VARYING A ROTATIONAL OR ANGULAR PHASE BETWEEN TWO ROTATIONAL SHAFTS

(75) Inventor: Masayasu Ushida, Okazaki (JP)

(73) Assignee: Nippondenso Co., Ltd. (JP)

( * ) Notice: Subject to any disclaimer, the term of this patent is extended or adjusted under 35 U.S.C. 154(b) by 0 days.

(21) Appl. No.: 09/025,836

(22) Filed: Feb. 19, 1998

Related U.S. Application Data

(62) Division of application No. 08/663,525, filed on Jun. 13, 1996.

(30) Foreign Application Priority Data

Jun. 14, 1995 (JP) ..... 7-147123
Oct. 17, 1995 (JP) ..... 7-268832
Nov. 28, 1995 (JP) ..... 7-308995

(51) Int. Cl.[7] ..... F01L 1/34

(52) U.S. Cl. ..... 123/90.17; 123/90.31; 74/568 R; 464/2

(58) Field of Search ..... 123/90.15, 90.16, 123/90.17, 90.31; 74/567, 568 R; 464/1, 2, 160

(56) References Cited

U.S. PATENT DOCUMENTS 4,091,776 5/1978 Clemens et al. .
4,858,572 8/1989 Shirai et al. ..... 123/90.15
5,056,477 10/1991 Linder et al. ..... 123/90.17

(List continued on next page.)

FOREIGN PATENT DOCUMENTS 363600 4/1990 (EP) .
680875 10/1952 (GB) .
1241923 8/1971 (GB) .
2157364 10/1985 (GB) .
2228780 9/1990 (GB) .
2241767 9/1991 (GB) .
2261931 6/1993 (GB) .
1-92504 4/1989 (JP) .
2-50105 4/1990 (JP) .
3-103619 4/1991 (JP) .
3-503197 7/1991 (JP) .
5-106412 4/1993 (JP) .
5-214907 8/1993 (JP) .
6-42317 2/1994 (JP) .
90/08248 7/1990 (WO) .
95/31633 11/1995 (WO) .

OTHER PUBLICATIONS

"Variable valve timing control for an Internal combustion engine" Japanese Invention Institute Technical Pub. No. 87–8631, Jul. 20, 1987 (w/English Abstract).

*Primary Examiner*—Weilun Lo
(74) *Attorney, Agent, or Firm*—Pillsbury Madison & Sutro, LLP

(57) ABSTRACT

A shoe housing 3 is connected to and rotatable together with an input shaft. A vane rotor 9 is connected to an output shaft and accommodated in shoe housing 3 so as to cause a rotation within a predetermined angle with respect to shoe housing 3. Vane rotor 9 and shoe housing 3 cooperatively define hydraulic chambers 10, 11, 12 and 13 whose volumes are variable in accordance with a rotational position of vane rotor 9 with respect to shoe housing 3. A locking member 7 is accommodated in vane rotor 9 and shiftable in a direction parallel to a rotational axis common to shoe housing 3 and vane rotor 9. And, an engaging bore 20, formed on a front plate 4 secured to shoe housing 3, receives locking member 7 through a tapered surface. With this arrangement, it becomes possible to provide a control apparatus for varying a rotational or angular phase between the input and output shafts, while adequately maintaining the durability of the apparatus with a simple configuration easy to manufacture and suitable for downsizing without causing hammering noises or increasing operational resistances.

6 Claims, 14 Drawing Sheets

U.S. PATENT DOCUMENTS

| | | | | |
|---|---|---|---|---|
| 5,107,804 | | 4/1992 | Becker et al. | 123/90.17 |
| 5,172,659 | | 12/1992 | Butterfield et al. | 123/90.17 |
| 5,184,578 | | 2/1993 | Quinn, Jr. et al. | 123/90.17 |
| 5,205,249 | | 4/1993 | Markley et al. . | |
| 5,228,417 | * | 7/1993 | Hara | 123/90.17 |
| 5,289,805 | | 3/1994 | Quinn, Jr. et al. | 123/90.17 |
| 5,343,834 | * | 9/1994 | Rembold et al. | 123/90.17 |
| 5,361,735 | | 11/1994 | Butterfield et al. | 123/90.17 |
| 5,367,992 | * | 11/1994 | Butterfield et al. | 123/90.17 |
| 5,450,825 | * | 9/1995 | Geyer et al. | 123/90.17 |
| 5,507,254 | * | 4/1996 | Melchior | 123/90.17 |
| 5,549,081 | * | 8/1996 | Ohlendorf et al. | 123/90.16 |
| 5,666,914 | | 9/1997 | Ushida | 123/90.17 |

* cited by examiner

CONTROL APPARATUS FOR VARYING A ROTATIONAL OR ANGULAR PHASE BETWEEN TWO ROTATIONAL SHAFTS

This is a division of application Ser. No. 08/663,525, filed Jun. 13, 1996.

BACKGROUND OF THE INVENTION

1. Field of the Invention

This invention generally relates to a rotational or angular phase control apparatus provided between an input shaft and an output shaft for varying the mutual rotational or angular phase between input and output shafts. For example, this invention can be applied to a valve timing control apparatus for an internal combustion engine which varies a rotational or angular phase of a cam shaft with respect to a crank shaft to vary the valve opening or closing timing for at least one of intake and exhaust valves.

2. Related Art

In ordinary internal combustion engines, rotation of a crank shaft is transmitted to a cam shaft by way of a timing belt, or a chain, or a gear. There are known some engines which comprise a valve timing control apparatus interposed between the crank shaft and the cam shaft to vary the rotational phase therebetween for varying the open-or-close timing of at least one of intake and exhaust valves. Such an apparatus is referred to as VVT (vriable valve timing apparatus).

The U.S. Pat. No. 4,858,572 (corresponding to Unexamined Japanese Patent Application No. HEI 1-92504, published in 1989) discloses this kind of valve timing control apparatus.

According to this conventional apparatus, a rotor is accommodated in a timing pulley. The rotor is provided with a total of six vanes each associated with a hydraulic chamber. Of six hydraulic chambers, three are communicated with one oil passage and the remaining three are accommodated with the other oil passage. These two oil passages are formed in the rotor, thereby supplying pressurized oil to each hydraulic chamber and causing a volume change in each hydraulic chamber. In response to this volume change of each hydraulic chamber, the rotational or angular phase of rotor can be varied with respect to the timing pulley.

Furthermore, this conventional apparatus comprises two knock pins serving as locking members. When the rotor is positioned at the most-advanced position or the most-retarded position, the rotor is locked with the timing pulley by either of these two knock pins.

According to this conventional apparatus, knock pins are disposed in radial directions so as to shift in radial directions. Hence, there is the possibility that these knock pins may be erroneously shifted in the radial direction when subjected to a large centrifugal force derived from rotation of rotor. In general, the arrangement of radially shiftable knock pins tends to enlarge the overall diameter of the apparatus, getting the downsizing of the apparatus difficult.

As knock pins are accommodated in the timing pulley, it is necessary to provide bolts protruding from the outermost end of the apparatus for closing the housing of the rotor. This also makes it difficult to reduce the size.

The configuration of each knock pin is a simple rod which is likely to fail to smoothly engage or enter into a coupling bore. Alternatively, if a large clearance is provided between the knock pin and the coupling bore to assure smoothness, noises will be caused due to the looseness of the knock pins.

Furthermore, there is the possibility that each knock pin of a simple rod may be deformed when received a strong stress acting in both of the rotational directions.

One knock pin is moved by one hydraulic pressure, while the other knock pin is moved by the other hydraulic pressure. When the valve timing is set at an intermediate position, or during the switching operation of knock pins, knock pins may be frictionally slide on the surface of the rotor. It will promote the wear and worsen the durability of frictional parts, while increasing operational resistances.

Moreover, if one of knock pins is damaged, the valve timing will be fixed at either one the most-retard position or the most-advanced position. If the valve timing is accidentally fixed at and not escapable from the most-advanced position (which is the valve timing preferably used for high engine speeds and improper for an idling or low engine speeds), it will result in the difficulty in the starting-up operation of the engine.

Yet further, according to the above-described apparatus, a plurality of oil passages are formed in the rotor so as to extend in the radial directions. A groove, serving as an oil passage, is also formed on the outer cylindrical wall of the rotor. Such oil passage arrangement forcibly requires complicated machining and drilling operations in manufacturing the outer surfaces of the rotor.

Still further, provision of six vanes complicates the configuration of the apparatus. In this respect, the U.S. Pat. No. 5,289,805 discloses a two-vane type rotor. However, the conventional two-vane type rotors are encountered with the difficulty in acquiring a satisfactory pressure-receiving area and a durable housing strength.

SUMMARY OF THE INVENTION

Accordingly, in view of above-described problems encountered in the prior art, a principal object of the present invention is to provide an improved vane-type rotational or angular phase control apparatus.

Another object of the present invention is to provide a rotational or angular phase control apparatus preferably applied to a valve timing control apparatus for an internal combustion engine.

Still another object of the present invention is to provide a compact apparatus comprising a lock mechanism for fixing an input shaft side and an output side.

Yet another object of the present invention is to solve the problems derived from the lock mechanism for fixing the input shaft side and the output side.

Another object of the present invention is to prevent the apparatus from incurring an adverse affection of the centrifugal force derived from the lock mechanism.

Still another object of the present invention is to prevent noises from occurring from the lock mechanism.

Yet another object of the present invention is to prevent the durability of the apparatus from deteriorating due to the lock mechanism.

Still another object of the present invention is to prevent operational resistances from increasing due to the lock mechanism.

Yet another object of the present invention is to prevent the engine from failing its start-up operation due to the lock mechanism.

Moreover, another object of the present invention is to realize a simple design apparatus easy to manufacture and suitable for downsizing.

Furthermore, another object of the present invention is to supply operational fluid to plural chambers by simplified oil passage arrangement.

The above-described objects of the present invention can be attained by providing a locking member (7) capable of shifting in parallel to the rotational axis common to the housing and the rotor. With this arrangement, accommodation of the locking member becomes compact. Furthermore, as the locking member is free from any centrifugal force, the position of the locking member can be surely controlled.

More specifically, a first aspect of the present invention provides a rotational or angular phase control apparatus interposed between first and second rotational shifts for varying a rotational or angular phase between the first and second rotational shafts, the apparatus comprising: a housing (1, 3, 4) connected to the first rotational shaft and rotatable together with the first rotational shaft; a rotor (9) connected to the second rotational shaft and accommodated in the housing so as to cause a rotation within a predetermined angle with respect to the housing; the rotor and the housing cooperatively defining a chamber whose volume is variable in accordance with a rotational position of the rotor with respect to the housing; a locking member (7) provided in one of the housing and the rotor and shiftable in a direction parallel to a rotational axis common to the housing and the rotor; and an engaging bore (20) provided in the other of the housing and the rotor for receiving the locking member.

The above-described objects of the present invention can be attained by providing a tapered surface on at least one of a pin (7) and an engaging bore (20) constituting the locking mechanism, so that they are locked or engaged through this tapered surface. This tapered configuration is effective to absorb or eliminate the positional dislocation between the pin and the engaging bore if caused by the manufacturing errors, assuring a complete engagement between these parts.

More specifically, a second aspect of the present invention provides a rotational or angular phase control apparatus interposed between first and second rotational shafts for varying a rotational or angular phase between the first and second rotational shafts, the apparatus comprising: a housing connected to the first rotational shaft and rotatable together with the first rotational shaft; a rotor connected to the second rotational shaft and accommodated in the housing so as to cause a rotation within a predetermined angle with respect to the housing; the rotor and the housing cooperatively defining a chamber whose volume is variable in accordance with a rotational position of the rotor with respect to the housing; a pin provided in one of the housing and the rotor; an engaging bore provided in the other of the housing and the rotor for receiving the pin; and a tapered surface provided at least one of the pin and the engaging bore so that the pin and the engaging bore are brought into contact with each other through the tapered surface.

Preferably, the engaging bore is an elongated bore extending in a direction crossing with the rotational direction. With this bore configuration, it can be surely prevented that the housing and the rotor are forcibly and undesirably urged in the directions different from their rotations.

The above-described objects of the present invention can be attained by providing a lock mechanism for locking the rotor in the housing so as to restrict a rotational displacement only when the housing and the rotor are brought into contact with each other at one end of the rotational direction. With this arrangement, a rotational torque acting in one rotational direction can be transmitted through the direction contact between the housing and the rotor. This is effective to reduce the amount of a torque applied on the locking member.

More specifically, a third aspect of the present invention provides a rotational or angular phase control apparatus interposed between first and second rotational shafts for varying a rotational or angular phase between the first and second rotational shafts, the apparatus comprising: a housing connected to the first rotational shaft and rotatable together with the first rotational shaft; a rotor connected to the second rotational shaft and accommodated in the housing so as to cause a rotation within a predetermined angle with respect to the housing; the rotor and the housing cooperatively defining a chamber whose volume is variable in accordance with a rotational position of the rotor with respect to the housing; and a lock mechanism for locking the rotor with the housing to restrict a rotational displacement of the rotor in the housing only when the rotor is brought into contact with the housing at one end of a rotational direction of the rotor.

Preferably, the locking member and the engaging bore are brought into contact with each other at their slant surfaces facing to the rotational direction. With this arrangement, the housing and the rotor are surely fixed with each other at the end of the rotational direction. Such slant surface arrangement can be easily realized by forming the tapered surface on at least one of the locking member and the engaging bore.

The above-described objects of the present invention can be attained by the locking member retractable into the one of the housing and the rotor against an urgent force of a mechanical member when operational fluid is supplied to any of hydraulic chambers. With this arrangement, the locking member is maintained in a complete accommodation condition (i.e. retracted condition) always when operational fluid is supplied to either of a pair of chambers. Hence, it is surely prevented that the operational resistances of the apparatus is increased by the frictional or sliding contact between the locking member and the housing or the rotor.

More specifically, a fourth aspect of the present invention provides a rotational or angular phase control apparatus interposed between first and second rotational shafts for varying a rotational or angular phase between the first and second rotational shafts, the apparatus comprising: a housing connected to the first rotational shaft and rotatable together with the firs rotational shaft; a rotor connected to the second rotational shaft and accommodated in the housing so as to cause a rotation within a predetermined angle with respect to the housing; the rotor and the housing cooperatively defining a pair of chambers whose volumes are oppositely variable in accordance with a rotational position of the rotor with respect to the housing; and a lock mechanism for locking the rotor with the housing at a predetermined angular position to restrict a rotational displacement of the rotor in the housing, wherein a lock mechanism comprises: a locking member retractable in one of the housing and the rotor, so as to lock the rotor with the housing in its protruding position and disengaging the rotor from the housing in its retracted position; a mechanical urging member urging the locking member toward the protruding position; and a hydraulic urging mechanism for introducing operational fluid of the chambers to push the locking member back to the retracted position against a resilient force of the mechanical urging member when operational fluid is supplied to any of the chambers.

The above-described objects of the present invention can be attained by setting the positional relationship between the locking member and the engaging bore in such a manner the valve timing of intake valves driven by the cam shaft becomes preferable for the engine start-up operation when the rotor and the housing are fixed by the lock mechanism. By adopting this arrangement, it becomes possible to assure the start-up operation of the engine.

More specifically, a fifth aspect of the present invention provides a valve timing control apparatus interposed between a crank shaft and a cam shaft for varying a rotational or angular phase between the crank shaft and the cam shaft so as to control a valve timing of at least an intake valve of an internal combustion engine, the apparatus comprising: a housing connected to and rotatable together with one of the crank shaft and the cam shaft; a rotor connected to the other of the crank shaft and the cam shaft and accommodated in the housing so as to cause a rotation within a predetermined angle with respect to the housing; the rotor and the housing cooperatively defining a chamber whose volume is variable in accordance with a rotational position of the rotor with respect to the housing; and a lock mechanism for locking the rotor to the housing at a predetermined angular position to restrict a rotational displacement of the rotor in the housing, in such a manner that the valve timing of the intake valve driven by the cam shaft becomes preferable for an engaging the start-up operation when the rotor and the housing are fixed by the lock mechanism.

Preferably, the lock mechanism fixes the rotor with the housing at the most-retarded position only.

The above-described objects of the present invention can be attained by providing a distribution oil passage communicating with advance hydraulic chambers (12, 13) and the other distribution oil passage communicating with retard hydraulic chambers (10, 11) independently at both ends of the rotor, respectively. Preferably, these distribution oil passages can be constituted by arc grooves (29, 30) extending in the circumferential direction and radial passages (31, 32, 34, 35) extending in the radial direction. By adopting this arrangement, two oil passages communicating with the paired hydraulic chambers can be surely separated with a simplified oil passage arrangement. This arrangement is preferable for oil distribution to plural chambers.

More specifically, a sixth aspect of the present invention provides a rotational or angular phase control apparatus interposed between first and second rotational shafts for varying a rotational or angular phase between the first and second rotational shafts, the apparatus comprising: a housing connected to the first rotational shaft and rotatable together with the first rotational shaft; a rotor connected to the second rotational shaft and accommodated in the housing so as to cause a rotation within a predetermined angle with respect to the housing; the rotor and the housing cooperatively defining a plurality of retard hydraulic chambers (10, 11) and a plurality of advance hydraulic chambers (12, 13), the retard hydraulic chambers causing volume changes opposed to volume changes of the advance hydraulic chambers in accordance with a rotational position of the rotor with respect to the housing; a first distribution oil passage including an arc groove (30) and a plurality of radial passages (34, 35) formed on one end of the rotor, the arc groove (30) extending in a circumferential direction and communicating with a first oil passage (38) formed in the second rotational shaft, while the radial passages (34, 35) extending from the arc groove (30) in radial directions and communicating with the advance hydraulic chambers (12, 13); and a second distribution oil passage including an arc groove (29) and a plurality of radial passages (31, 32) formed on the other end of the rotor, the arc groove (29) extending in a circumferential direction and communicating with a second oil passage (39) formed in the second rotational shaft, while the radial passages (31, 32) extending from the arc groove (29) in radial directions and communicating with the retard hydraulic chambers (10, 11).

The above-described objects of the present invention can be attained by adopting a three-vane type rotor arrangement wherein three retard chambers (90, 91, 92) and three advance chambers (93, 94, 95) are defined between three shoes (63*a*, 63*b*, 63*c*) and three vanes (64*a*, 64*b*,64*c*). With this arrangement, it becomes possible to attain satisfactory performances with simplified configuration and components easy to manufacture.

More specifically, a seventh aspect of the present invention provides a rotational or angular phase control apparatus interposed between first and second rotational shafts for varying a rotational or angular phase between the first and second rotational shafts, the apparatus comprising: a housing connected to the first rotational shaft and rotatable together with the first rotational shaft; a rotor connected to the second rotational shaft and accommodated in the hosing so as to cause a rotation within a predetermined angle with respect to the housing; the housing including a total of three shoes (63*a*, 63*b*, 63*c*) equally spaced along a cylindrical wall thereof; and the rotor including a total of three vanes (64*a*, 64*b*, 64*c*) accommodated in circumferential gaps between the three shoes so as to define retard hydraulic chambers (90, 91, 92) and advance hydraulic chambers (93, 94, 95) at leading and trailing sides of these vanes.

Preferably, three shoes have hollow spaces into which bolts (66*a*, 66*b* and and 66*c*) are inserted for fixing the housing component members.

The above-described objects of the present invention can be attained by providing a movable portion of the lock mechanism in the rotor so that the movable portion is accommodated in an angular region corresponding to a vane formed on the rotor. With this arrangement, it becomes possible to realize a compact arrangement.

More specifically, an eighth aspect of the present invention provides a rotational or angular phase control apparatus interposed between first and second rotational shafts for varying a rotational or angular phase between the first and second rotational shafts, the apparatus comprising: a housing having a shoe protruding from an inside wall thereof and connected to and rotatable together with the first rotational shaft; a rotor having a vane cooperative with the shoe to define a pair of chambers, the rotor being connected to the second rotational shaft and accommodated in the housing so as to cause a rotation within a predetermined angle with respect to the housing; and a lock mechanism locking the housing with the rotor, wherein the vane extends from a cylindrical surface of the rotor within a predetermined region, and a movable portion of the lock mechanism is accommodated in an anguler region corresponding to the vane.

Preferably, the rotor accommodates the hydraulic actuation device for shifting the movable portion of the lock mechanism. By this arrangement, an oil supply passage can be relatively easily formed so as to extend from the rotor side to the hydraulic actuation device.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
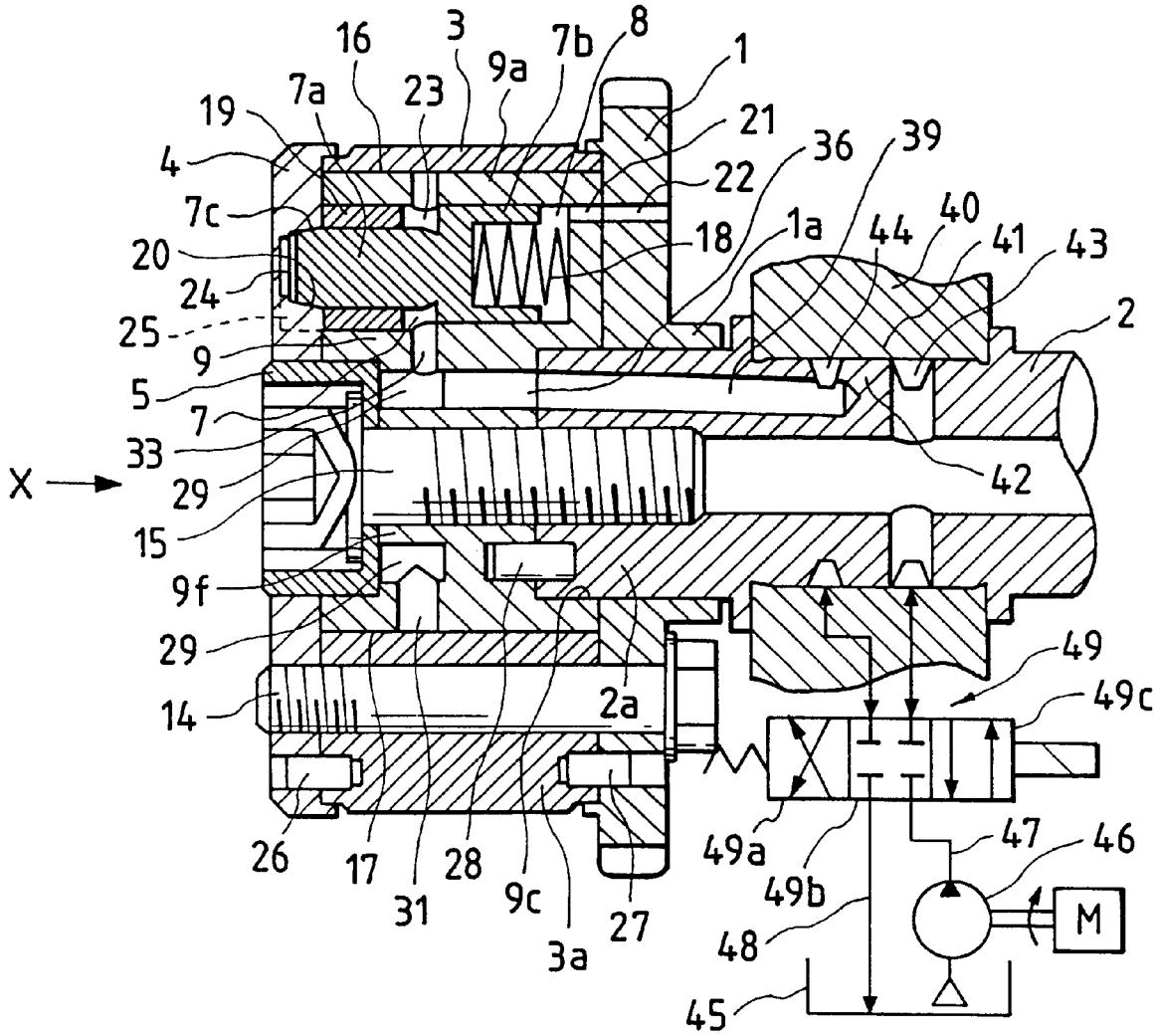
FIG. 1 is a cross-sectional view showing an arrangement of a valve timing control apparatus in accordance with a first embodiment of the present invention, taken along a line I—I of FIG. 2.

Preferred embodiments of the present invention will be explained in greater detail hereinafter, with reference to the accompanying drawings. Identical parts are denoted by the same reference numeral throughout views.

First Embodiment

A valve timing control apparatus for an internal combustion engine in accordance with a first embodiment of the present invention will be explained with reference to FIGS. 1 through 8.

A chain sprocket 1, shown in FIG. 1, receives a driving force from a crank shaft (i.e. a driving shaft) of an internal combustion engine (not shown) via a chain (not shown). Chain sprocket 1, hence, rotates in synchronism with the crank shaft. A cam shaft 2, serving as a driven shaft, receives a driving force from chain sprocket 1, and opens or closes at least either of an intake valve and an exhaust valve (both not shown). Cam shaft 2 can cause a mutual rotation with respect to chain sprocket 1 within a predetermined angular phase. Both of chain sprocket 1 and cam shaft 2 rotate in the clockwise direction, when seen from the direction of an arrow X shown in FIG. 1. This rotational direction is hereinafter referred to as "advance direction".

Figure 2:
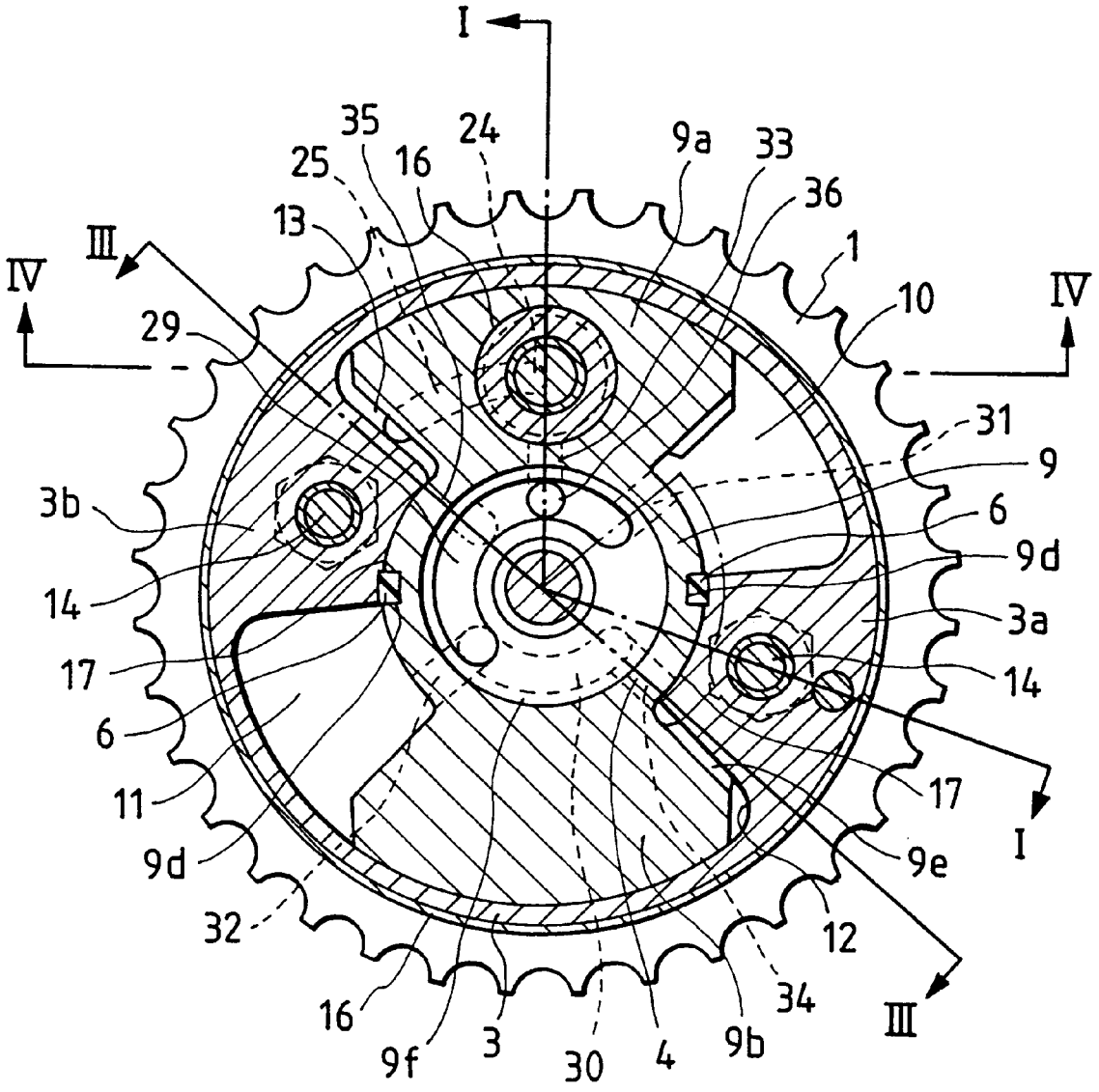
FIG. 2 is a transverse cross-sectional view showing the arrangement of a valve timing control apparatus in accordance with the first embodiment of the present invention.

As shown in FIGS. 1 and 2, chain sprocket 1, a shoe housing 3, and a front plate 4 are cooperative to serve as a housing member, and are securely and coaxially fixed together by means of a plurality of bolts 14.

Chain sprocket 1 has a boss 1*a* at the center thereof. An inner cylindrical wall of boss 1*a* is rotatably coupled around an outer cylindrical surface of a front end 2*a* of cam shaft 2. Front plate 4 and shoe housing 3 are fixed by a knock pin 26 to position them in a predetermined rotational angular relationship. Shoe housing 3 and chain sprocket 1 are fixed by a knock pin 27 to position them in a predetermined rotational angular relationship.

As shown in FIG. 2, shoe housing 3 has a pair of shoes 3*a* and 3*b* opposing each other and being configured into a trapezoidal shape. Opposing inner faces of shoes 3*a* and 3*b* are configured into cylindrical surfaces having an arc cross section. A pair of sector spaces are defined at circumferential both sides of shoes 3*a* and 3*b*. These sector spaces serve as chambers for accommodating vanes 9*a* and 9*b* later described.

As shown in FIGS. 1 and 2, a vane rotor 9 comprises a pair of vanes 9*a* and 9*b* extending from and integral with a cylindrical boss 9*f* formed at the center thereof. Vanes 9*a* and 9*b* are respectively configured into a sector shape. Vanes 9*a* and 9*b* extend from cylindrical boss 9*f* in radially opposing directions. Vane 9*a* is accommodated in one circumferential sector space defined between shoes 3*a* and 3*b*, while the other vane 9*b* is accommodated in another circumferential sector space defined between shoes 3*a* and 3*b*. Hence, vanes 9*a* and 9*b* can rotate with respect to shoe housing 3 within a predetermined angle defined by the sector spaces formed between shoes 3*a* and 3*b*.

A cylindrical bore 9*c* formed at the rear end of vane rotor 9 is coupled with the front end 2*a* of cam shaft 2. A bolt 15 securely fastens vane rotor 9 with cam shaft 2. Vane rotor 9 and cam shaft 2 are fixed by a knock pin 28 to position them in a predetermined rotational angular relationship.

A cylindrical protrusion 5, integrally fixed to vane rotor 9, is rotatably coupled with an inner cylindrical wall of front plate 4. As clearly shown in FIG. 2, a tiny clearance 16 is provided between the outer cylindrical wall of each vane 9*a* or 9*b* and the inner cylindrical wall of shoe housing 3. A tiny clearance 17 is provided between the cylindrical boss 9*f* and the cylindrical face of each shoe 3*a* or 3*b*. Thus, vane rotor 9 can cause a rotation with respect to shoe housing 3, keeping a hermetical sealing therebetween.

One retard hydraulic chamber 10 is defined between shoe 3*a* and vane 9*a*. Another retard hydraulic chamber 11 is defined between shoe 3*b* and vane 9*b*. One advance hydraulic chamber 12 is defined between shoe 3*a* and vane 9*b*. Another advance hydraulic chamber 13 is defined between shoe 3*b* and vane 9*a*. The axial length of vanes 9*a* and 9*b* is slightly shorter than that of shoe housing 3 interposed between front plate 4 and chain sprocket 1.

With the arrangement above described, cam shaft 2 and vane rotor 9 can cause a coaxial rotation with respect to the housing member, i.e., an assembly consisting of chain sprocket 1, shoe housing 3 and front plate 4.

As shown in FIG. 1, stopper piston 7 serving as a locking or engaging member, is housed in a hollow space of vane 9*a* of vane rotor 9. Stopper piston 7 comprises a cylindrical smaller-diameter portion 7*a* and a cylindrical larger-diameter portion 7*b*. A front end portion 7*c* of smaller-diameter portion 7*a* is tapered at its tip end. A stopper bore 20 serves as a mating or associated member into which stopper piston 7 is received or engaged. In other words, the diameter of front end portion 7*c* is reduced gradually as it approaches the stopper bore 20.

The larger-diameter portion 7*b* of stopper piston 7 is housed in an accommodation hole 8 opened in vane 9*a*. Larger-diameter portion 7*b* is supported by the inner cylindrical wall of accommodation hole 8 and slidable in the axial direction of cam shaft 2.

A spring 18, acting as an urging means, is incorporated in accommodation hole 8, so as to elastically urge stopper piston 7 in the axial direction from the right in FIG. 1. A guide ring 19 is loosely or forcibly coupled with the inner wall of vane 9*a* which defines the accommodation hole 8. Guide ring 19 is loosely coupled with the outer wall of smaller diameter portion 7*a* of stopper piston 7. Accordingly, stopper piston 7 is housed in vane 9*a* so as to be slidable in the axial direction of cam shaft 2. Furthermore, stopper piston 7 is resiliently urged toward front plate 4 by spring 18.

Figure 4:
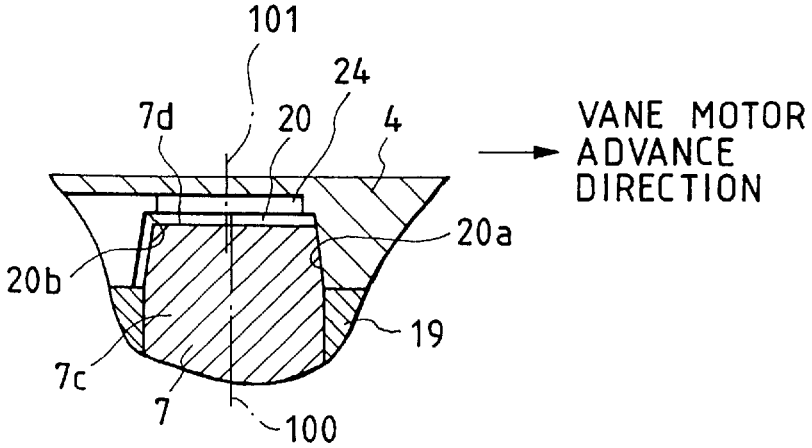
FIG. 4 is a cross-sectional view taken along a line IV—IV of FIG. 2.

As shown in FIG. 4, the taper angle of front end portion 7*c* of stopper piston 7 is set to be identical with the taper angle of stopper bore 20. When stopper piston 7 is inserted into stopper bore 20, a front edge surface 7*d* of stopper piston 7 is not brought into contact with an upper surface 20*b* of stopper bore 20.

As shown in FIGS. 1 and 2, no pressurized oil is supplied into hydraulic pressure chambers 23 and 24 when the position of vane rotor 9 with respect to shoe housing 3 is a most-retarded position which serves as a restricting position. Hence, stopper piston 7 is coupled with stopper bore 20 by the resilient force of spring 18. In this case, a stopper portion 9*a* formed at a retard side of vane 9*b* is brought into contact with the side surface of shoe 3*a*. Thus, vane rotor 9 directly receives a driving force from shoe housing 3.

The positional relationship between stopper piston 7 and stopper bore 20 is designed in such a manner that shoe housing 3 and vane rotor 9 are mutually pressed by each other when they are located at their most-retarded positions. More specifically, in the most-retarded position of FIG. 2 wherein stopper portion 9*e* of vane 9*b* is brought into contact with the side surface of shoe 3*a*, the axial center 100 of stopper piston 7 is offset from the axial center 101 of stopper bore 20 toward the advance direction of the vane rotor 9 as shown in FIG. 4.

When stopper piston 7 is coupled with stopper bore 20, a contact of the tapered outer wall of stopper piston 7 to the tapered inner wall of stopper bore 20 makes it possible that stopper piston 7 acts as a wedge against stopper bore 20.

Accordingly, under an urgent force acting in the axial direction of stopper piston 7, vane rotor 9 and shoe housing 3 are mutually shifted in the rotational direction.

In the first embodiment, as shown in FIG. 4, stopper piston 7 and stopper bore 20 are brought into contact with their tapered surfaces at the advance position opposed to the most-retarded position serving as the restricting position. Therefore, the urging force of stopper piston 7 acting in its axial direction is turned into an urging force of the tapered surface acting in the rotational direction. Vane rotor 9 hence rotates in the counterclockwise direction in FIG. 2, while shoe housing 3 is urged in the countercockwise direction. Vane rotor 9 hence rotates in the counterclockwise direction in FIG. 2, while shoe housing 3 is urged in the clockwise direction. This causes an urging force pressing stopper portion 9*e* to the side surface of shoe 3*a*. Thus, shoe housing 3 and vane rotor 9 are firmly restrained.

In short, stopper piston 7 is engaged with stopper bore 20 at their slant surfaces facing to the rotational direction, so that an axial urging force of stopper piston 7 is converted into an urging force acting in a mutual rotational direction between shoe housing 3 and vane rotor 9, thereby giving a driving force for pressing vane rotor 9 to shoe housing 3.

Regarding the positional relationship between stopper piston 7 and stopper bore 20, it should be noted that the abovedescribed wedge effect is surely obtained even under the existence of some manufacturing errors as far as both are brought into contact with each other at predetermined side surfaces in the rotational direction of vane rotor 9.

As shown in FIG. 1, a drain hole 21 is opened on the side wall of vane 9*a* and extends from accommodation hole 8 toward chain sprocket 1. An atmospheric hole 22 is opened on chain sprocket 1. Drain hole 21 of vane 9*a* meets atmospheric hole 22 of chain sprocket 1 when vane rotor 9 is in the most-retarded position. Hence, the space behind stopper piston 7 accommodating spring 18 therein is maintained at an atmospheric pressure at this moment.

As shown in FIG. 1, a hydraulic chamber 23 is defined between guide ring 19 and larger-diameter portion 7*b* of piston 7. A hydraulic chamber 24 is defined between stopper bore 20 of front plate 4 and smaller-diameter portion 7*a* of stopper piston 7. Hydraulic chamber 24 is communicated with advance hydraulic chamber 13 through oil passage 25 formed on front plate 4.

Figure 3:
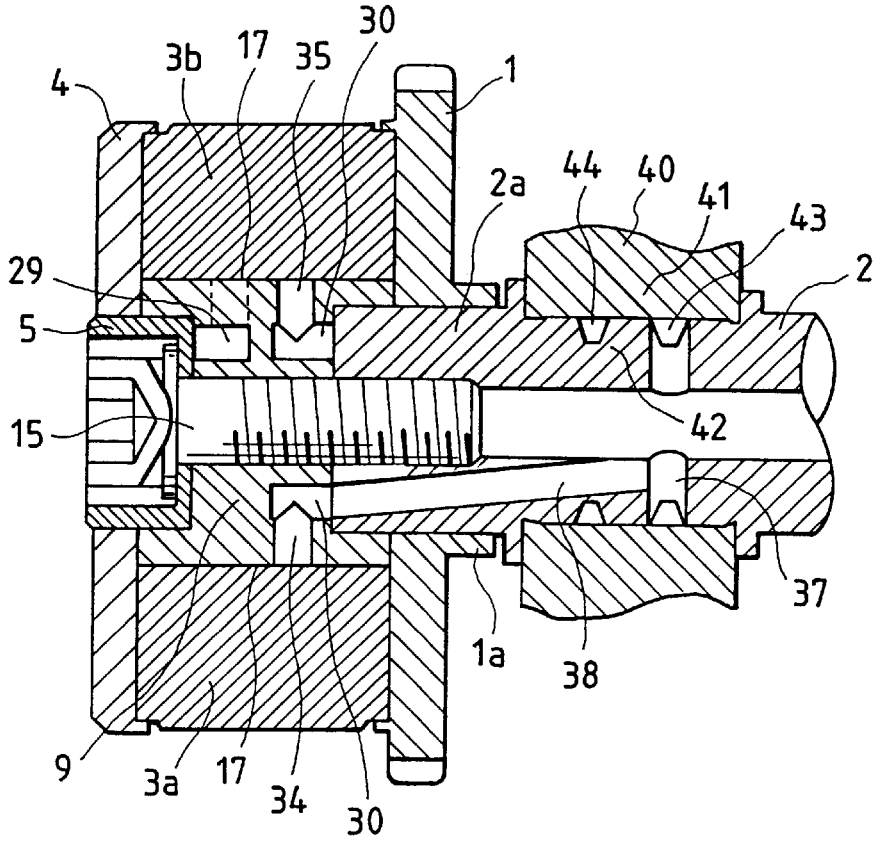
FIG. 3 is a cross-sectional view taken along a line III—III of FIG. 2.

As shown in FIGS. 1, 2 and 3, vane rotor 9 is provided with two oil passages 29 and 30 configured into arc grooves offset in both circumferential and axial directions. Oil passage 29 is defined between cylindrical boss 9*f* and cylindrical protrusion 5. The other oil passage 30 is defined between cylindrical boss 9*f* and cam shaft 2. Oil passage 29 is communicated with retard hydraulic chambers 10 and 11 via oil passages 31 and 32, respectively. Meanwhile, oil passage 30 is communicated with advance hydraulic chambers 12 and 13 via oil passages 34 and 35, respectively. Furthermore, oil passage 29 is communicated with an oil passage 36 which is communicated with an oil passage 39 formed in cam shaft 2 through the axial abutting surfaces of vane rotor 9 and cam shaft 2. Oil passage 30 is communicated with an oil passage 38 formed in cam shaft 2 through the axial abutting surfaces of vane rotor 9 and cam shaft 2.

In this manner, oil passages 29 and 30 are formed at axial both ends of cylindrical boss 9*f*. With this arrangement, distribution of pressurized oil to each hydraulic chamber can be simplified. Furthermore, simplifying the oil passage arrangement is effective to prevent oil passages from interfering with each other in cylindrical boss 9*f*, as well as to reduce the size of cylindrical boss 9*f*. Moreover, fabricating oil passages in cylindrical boss 9*f* can be facilitated.

As shown in FIG. 1, a journal 42 of cam shaft 2 is rotatably supported by bearing 41 formed on cylinder head 40 so as not to shift in the axial direction of cam shaft 2. Two circular or ring groove 43 and 44 are formed on the outer cylindrical surface of journal 42. An oil supply passage 47 feeds pressurized oil supplied from pump 46, while an oil drain passage 48 discharges oil to oil tank 45. Oil supply passage 47 and oil drain passage 48 are selectively connected to or disconnected from ring grooves 43 and 44 by shifting a switching valve 49. Pump 46 and switching valve 49 cooperatively constitute a hydraulic actuating means. In this embodiment, switching valve 49 is a well-known four port guide valve.

As shown in FIG. 3, outer groove 43 is connected with oil passages 37 and 38 successively extending in cam shaft 2. The remote end of oil passage 38 is communicated with oil passage 30 formed in vane rotor 9 across the axial abutting surfaces of vane rotor 9 (i.e. cylindrical boss 9*f*) and cam shaft 2.

As shown in FIG. 1, outer groove 44 is connected with oil passage 39 extending in cam shaft 2. The remote end of oil passage 39 is communicated with oil passage 36 formed in vane rotor 9 across the axial abutting surfaces of vane rotor 9 (i.e. cylindrical boss 9*f*) and cam shaft 2.

With above oil passage arrangement, pressurized oil of pump 46 can be selectively supplied to ring grooves 43 and 44 by switching valve 49. Hence, pressurized oil of pump 46 can be selectively supplied to retard hydraulic chambers 10, 11 and hydraulic chamber 23, or to advance hydraulic chambers 12, 13 and hydraulic chamber 24. And, oil from these chambers can be drained to oil tank 45.

Clearance 16, provided between the outer cylindrical wall of each vane 9*a* or 9*b* and the inner cylindrical wall of shoe housing 3, is desirably formed as small as possible, since it is effective to substantially separate or isolate retard hydraulic chamber 10 (or 11) from its associated advance hydraulic chamber 13 (or 12) via relatively long clearance 16.

Clearance 17, provided between the cylindrical boss 9*f* and the cylindrical face of each shoe 3*a* or 3*b*, is relatively short. Therefore, a sealing member 6 is provided in a groove 9*d* of vane rotor 9 to enhance the sealing ability and prevent retard hydraulic chamber 10 (or 11) from communicating with its associated advance hydraulic chamber 13 (or 12) via short clearance 17.

To allow vane rotor 9 to rotate in shoe housing 3, a sliding clearance is necessarily provided between each axial end surface of vane rotor 9 and the inside surface of shoe housing 3 or chain sprocket 1. To eliminate the possibility that oil may leak from one hydraulic chamber to the other hydraulic chamber through this sliding clearance, this sliding clearance is desirably formed as small as possible by setting the axial width of vane rotor 9 slightly smaller than the axial width of shoe housing 3. Vanes 9*a* and 9*b* have long circumferential lengths; therefore, they have wide lateral cross sections effective to prevent oil from leaking between hydraulic chambers. Hence, each hydraulic chamber can be adequately maintained at a desired pressure level. Thus, it becomes possible to realize a highly accurate control of the rotation of vane rotor 9 with respect to shoe housing 3. Furthermore, large lateral cross sections of vanes 9*a* and 9*b* are effective to facilitate the accommodation of stopper piston 7.

Next, an operation of the above-described valve timing control apparatus will be explained.

Before an engine start-up operation, pressurized oil is not yet introduced into hydraulic chambers 23 and 24 from pump 46. In this moment, as shown in FIGS. 1 and 2, vane rotor 9 is held at the most-retarded position with respect to shoe housing 3. Stopper portion 9*e* of vane 9*b* is brought into contact with shoe 3*a* at the retard side. Hence, a rotational drive force is transmitted from chain sprocket 1 to cam shaft 2 via shoe housing 3 and vane rotor 9. Stopper piston 7, urged by a resilient force of spring 18, is engaged with stopper bore 20 in such a manner that the tapered surface of front end portion 7*c* of stopper piston 7 is brought into contact with the tapered surface of stopper bore 20 at the advance side.

Through this engagement, vane rotor 9 and shoe housing 3 are urged in the rotational direction and are firmly fixed or locked with each other. Accordingly, even if a positive or negative reverse rotational torque acts on cam shaft 2 for actuating at least one of intake and exhaust valves, vane rotor 9 is surely prevented from moving or shifting with respect to shoe housing 3 in both retard and advance directions. Thus, it becomes possible to eliminate the vibrations caused by mutual rotations while preventing generation of hammering noises.

Figure 5:
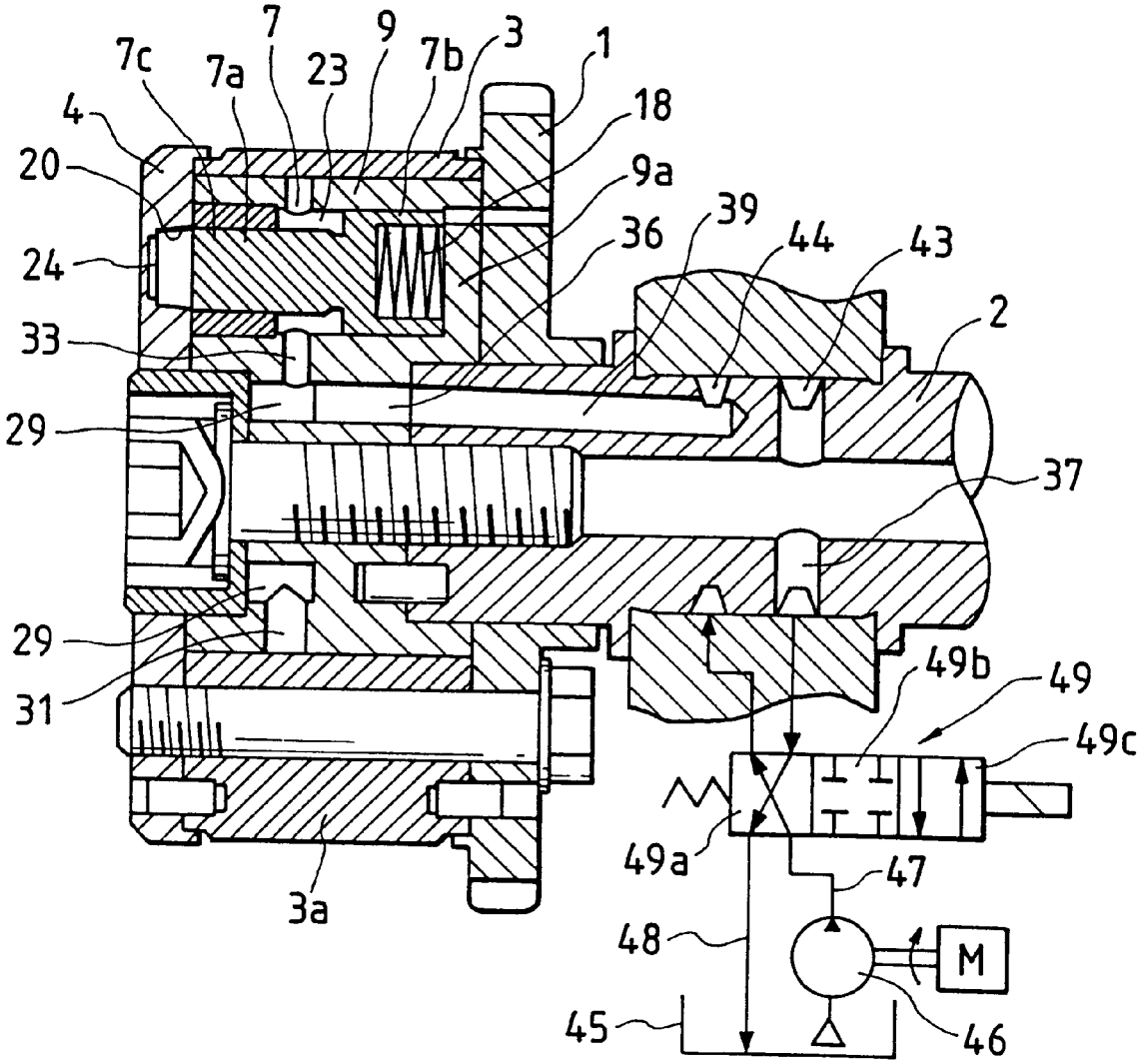
FIG. 5 is a vertical cross-sectional view showing a condition of the valve timing control apparatus of the first embodiment of the present invention wherein a stopper piston is pulled out of a stopper bore.

As shown in FIG. 5, upon selection of position 49*a* in switching valve 49, pressurized oil of pump 46 is fed to retard hydraulic chambers 10, 11 and hydraulic chamber 23 via ring groove 44 and oil passages 39, 36, 29, 31, 32 and 33. By supplying pressurized oil into hydraulic chamber 23, stopper piston 7 receives a force proportional to a difference between pressure-receiving areas of larger-diameter portion 7*b* and smaller-diameter portion 7*a* of stopper piston 7.

This hydraulic pressure acts on stopper piston 7 so as to push stopper piston 7 along the axial direction of accommodation hole 8 toward chain sprocket 1 against the resilient force of spring 18. Hence, front end portion 7*c* of stopper piston 7 is completely pulled out of or disengaged from stopper bore 20 of front plate 4. Thus, vane rotor 9 is released from the restraint by shoe housing 3. However, hydraulic pressure of retard hydraulic chambers 10 and 11 act on side surfaces of vanes 9*a* and 9*b*. Vane rotor 9 is hence held at the most-retarded position with respect to shoe housing 3 as shown in FIG. 2.

For this reason, no hammering noises is produced between vane rotor 9 and shoe housing 3. A small amount of oil, leaking from retard hydraulic chambers 10, 11 to advance hydraulic chambers 12, 13, is discharged to oil tank 45 through oil passages 34, 35, 30, 38, 37, ring groove 43 and switch valve 49 (position 49*a*).

Figure 6:
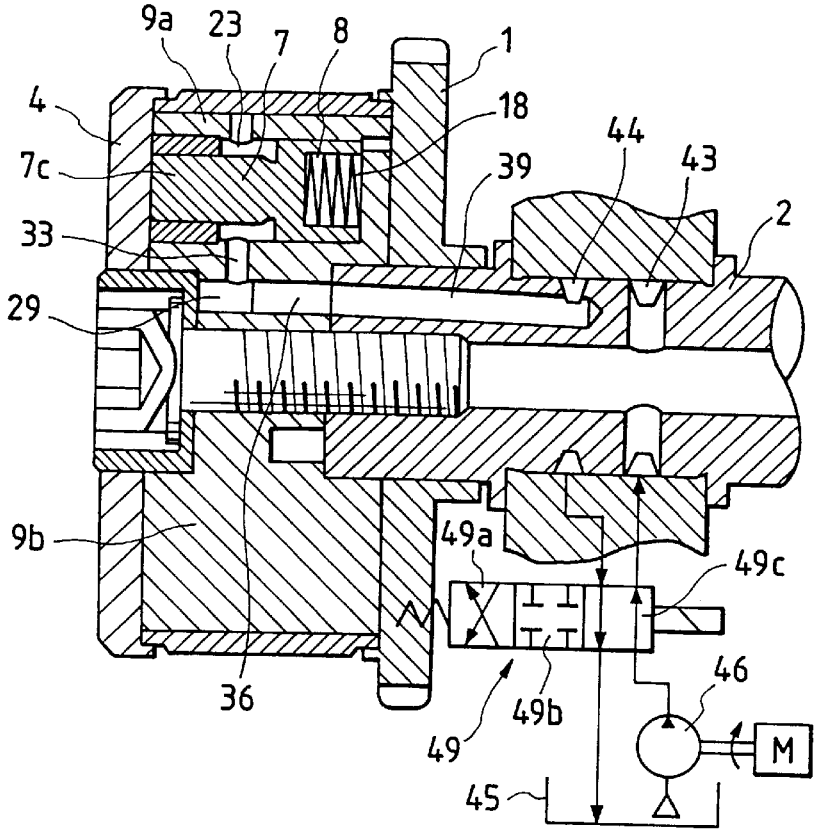
FIG. 6 is a vertical cross-sectional view showing a condition wherein a vane rotor is rotated in an advanced direction with respect to a shoe housing of the first embodiment of the present invention.

Switching valve 49 can be switched from position 49*a* shown in FIG. 5 to the other activating position 49*c* shown in FIG. 6. Pressurized oil is fed from pump 46 to advance hydraulic chambers 12, 13 via ring groove 43, oil passages 37, 38, 30, 34 and 35 and also to hydraulic chamber 24 through oil passage 25. On the other hand, oil stored in retard hydraulic chambers 10, 11 and hydraulic chamber 23 is drained to oil tank 45.

In this case, in accordance with reduction of oil pressure in hydraulic chamber 23, stopper piston 7 starts returning in stopper bore 20 since the resilient force of spring 18 exceeds the oil pressure. However, according to the arrangement of the first embodiment, the oil pressure force of hydraulic chamber 24 acts on the front end surface 7*d* of stopper piston 7. Therefore, stopper piston 7 in accommodation hole 8 is continuously pushed toward chain sprocket 1 against the resilient force of spring 18.

Under this condition, the oil pressure force of advance hydraulic chambers 12 and 13 acts on the side surfaces of vanes 9*a* and 9*b*. Thus, vane rotor 9 causes a rotation in the clockwise direction, i.e. an advance direction, with respect to shoe housing 3. With this rotation of vane rotor 9 in the clockwise direction, the valve timing of cam shaft 2 can be advanced.

After vane rotor 9 rotates with respect to shoe housing 3, the front end portion 7*c* of stopper piston 7 is dislocated from the stopper bore 20 of front plate 4 in the circumferential direction. Hence, stopper piston 7 is no longer engaged with stopper bore 20.

Figure 7:
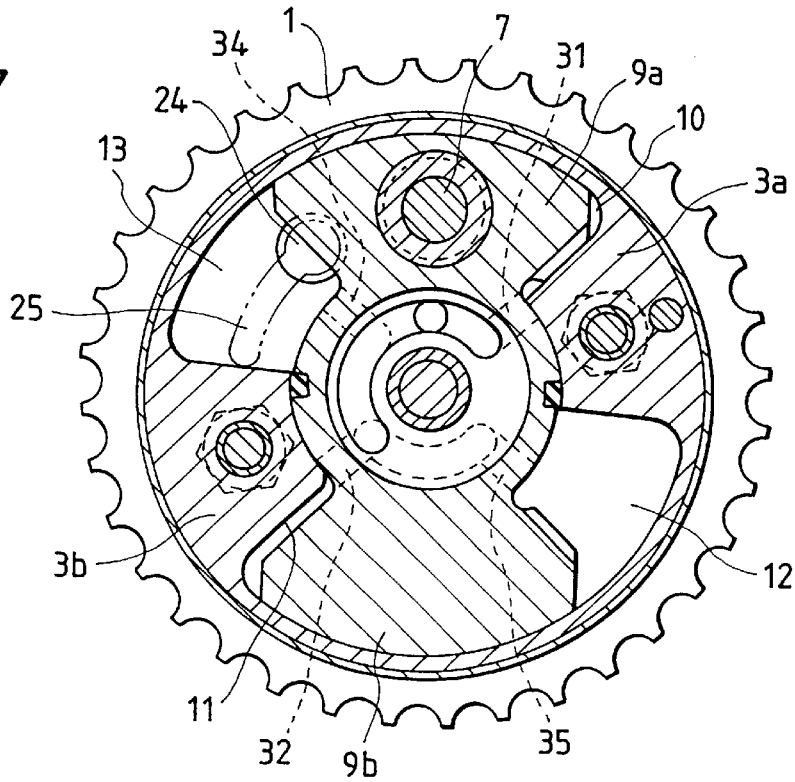
FIG. 7 is a transverse cross-sectional view showing the valve timing control apparatus in the condition of FIG. 6.
Figure 8:
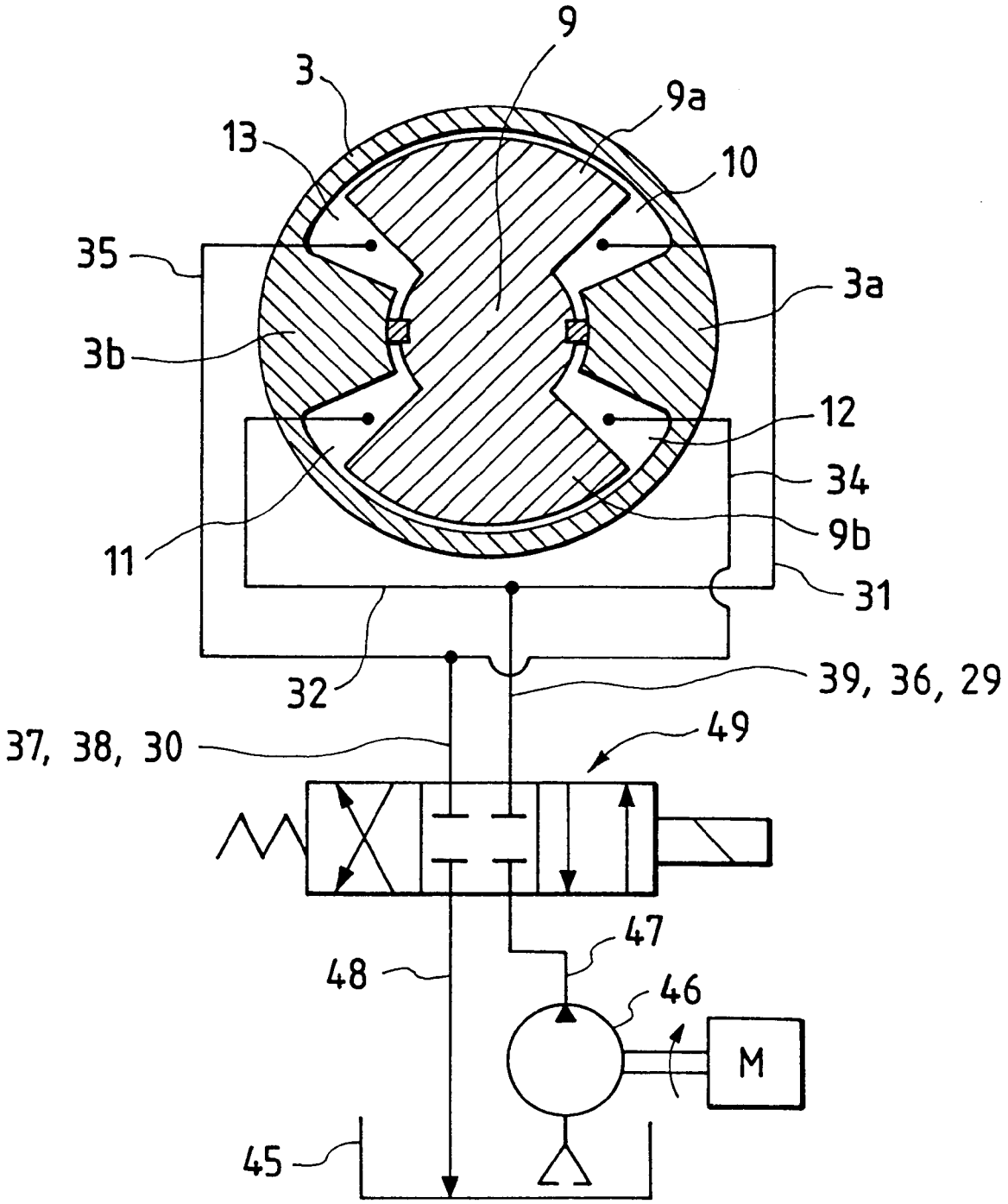
FIG. 8 is a schematic view showing a hydraulic pressure control circuit in accordance with the first embodiment of the present invention.

FIG. 7 shows a condition where van rotor 9 is in a most-advanced position with respect to shoe housing 3. When switching valve 49 is switched to position 49*a* from the condition of FIG. 7, vane rotor 9 cause a rotation in the counterclockwise direction, i.e. in the retard direction, with respect to shoe housing 3, when seen from the direction of "X" in FIG. 1. With this rotation of vane rotor 9 in the counterclockwise direction, the valve timing of cam shaft 2 is retarded.

When switching valve 49 selects a neutral position 49*b* in the transition period where vane rotor 9 is rotating with respect to shoe housing 3 in the advance or retard direction. Retard hydraulic chambers 10, 11 and advance hydraulic chambers 12, 13 are closed so as to receive no oil supply or cause no oil drain. Hence, vane rotor 9 can be arbitrarily held at an intermediate position, thereby realizing an intermediate valve timing as desired.

As described above, stopper piston 7 is engaged with stopper bore 20 of front plate 4 when vane rotor 9 is held at the most-retarded position with respect to shoe housing 3 under no supply of pressurized oil. When pressurized oil is introduced, stopper piston 7 is disengaged from stopper bore 20.

According to the first embodiment of the present invention, the wedge effect by the tapered surfaces of stopper bore 20 and stopper piston 7 enhances the direct connection between the housing member and the vane member. Hence, it becomes possible to firmly fix or lock the vane member to the housing member in the arrangement that the housing member and the vane member are coaxially disposed.

Furthermore, the front end portion 7*c* of stopper piston 7 is tapered so as to be slidable in the axial direction thereof. This tapered configuration is effective to eliminate the positional dislocation between stopper piston 7 and stopper bore 20 if caused by the manufacturing errors, assuring complete engagement between stopper piston 7 and stopper bore 20.

Second Embodiment

A second embodiment of the present invention will be explained with reference to FIGS. 9 and 10. According to the second embodiment, stopper piston 7 of the first embodiment is replaced by a stopper piston 50. Furthermore, guide ring 19 of the first embodiment is replaced by a guide ring 51 which is housed in vane 9*a*.

Figure 9:
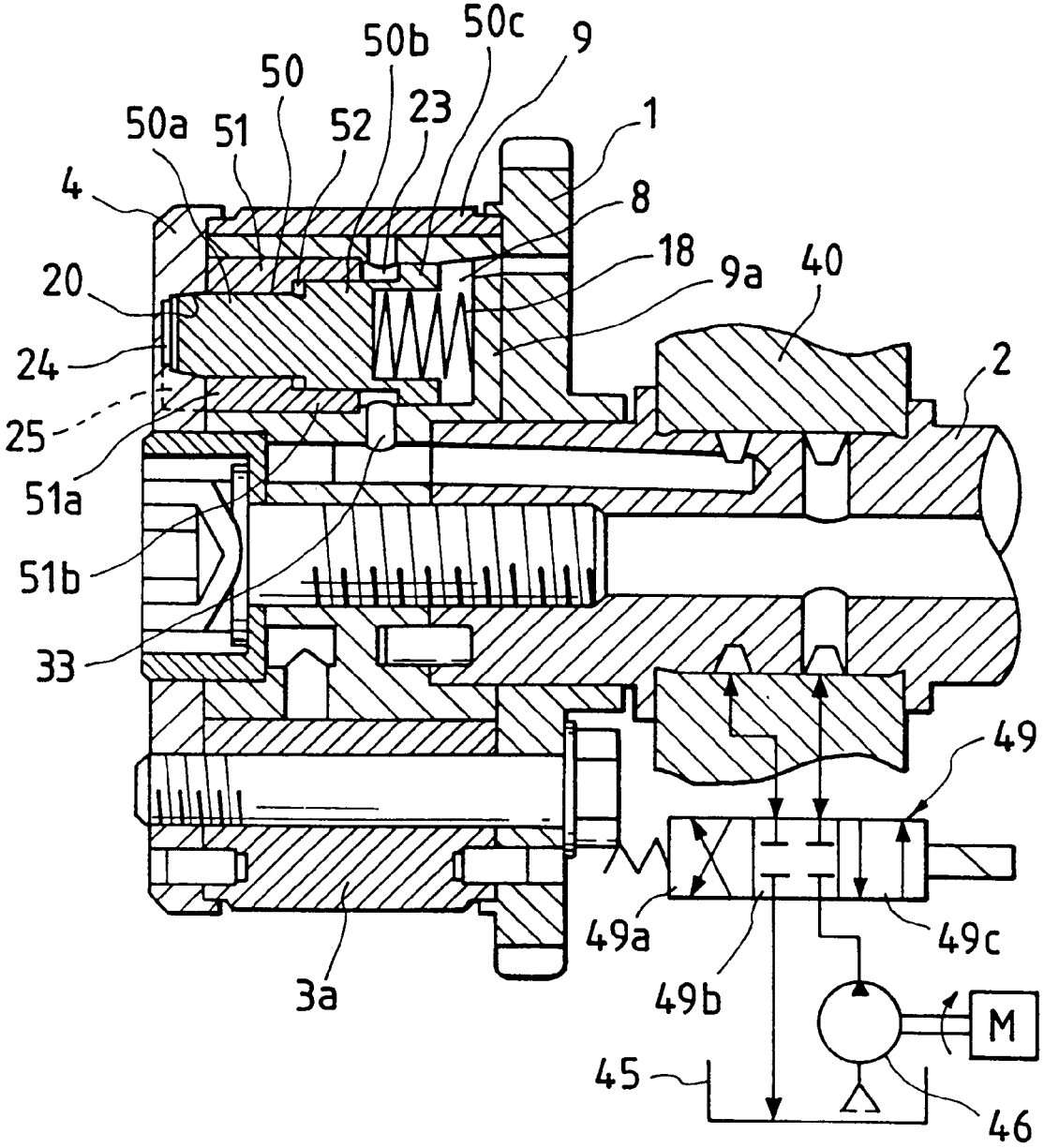
FIG. 9 is a vertical cross-sectional view showing the arrangement of a valve timing control apparatus in accordance with a second embodiment of the present invention.

FIG. 9 shows a condition where stopper piston 50 is engaged with stopper bore 20 of front plate 4. FIG. 10 shows a condition where stopper piston 50 is pulled out or disengaged from stopper bore 20 by introduction of pressurized oil into hydraulic chamber 23.

Stopper piston 50 consists of a smaller-diameter portion 50*a*, a medium-diameter portion 50*b* and a larger-diameter portion 50*c* sequentially aligned in this order. Guide ring 51 comprises a smaller-inner-diameter portion 51*a* and a larger-inner-diameter portion 51*b*. Guide ring 51 is forcibly inserted into a cylindrical hole of vane rotor 9, and firmly fixed there. Stopper piston 50 can cause a slide movement with respect to guide ring 51.

The inner diameter of smaller-inner-diameter portion 51*a* is substantially the same as the outer diameter of smaller-diameter portion 50*a* of stopper piston 50. The inner diameter of larger-inner-diameter portion 51*b* is substantially the same as the outer diameter of medium-diameter portion 50*b* of stopper piston 50. A damper chamber 52 of a ring shape is defined between the outer cylindrical surface (smaller-diameter portion 50*a* and medium-diameter portion 50*b*) of stopper piston 50 and the inner cylindrical wall of guide ring 51. Damper chamber 52 is a substantially closed space which provide a hermetical space acting as a fluid damper.

Before an engine start-up operation, pressurized oil is not yet introduced from pump 46 into hydraulic chamber 23 or 24. In this moment, as shown in FIG. 9, vane rotor 9 is held at the most-retarded position with respect to shoe housing 3. Stopper piston 50, urged by a resilient force of spring 18, is engaged with stopper bore 20 to firmly connect vane rotor 9 to front plate 4.

Figure 10:
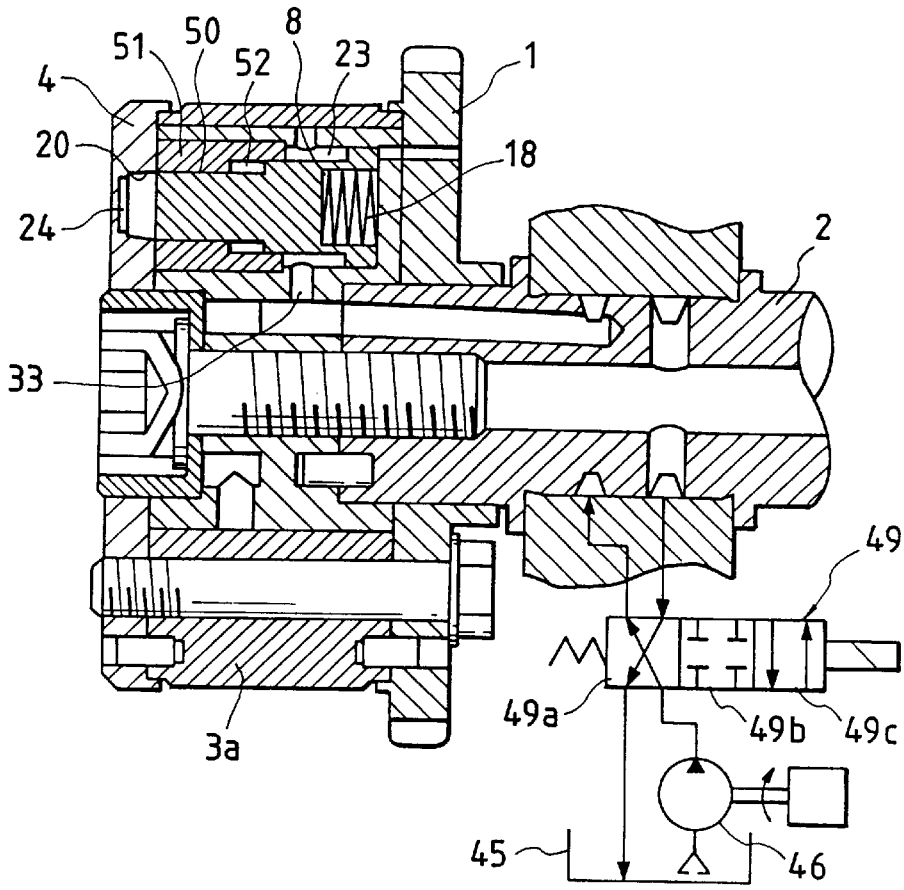
FIG. 10 is a vertical cross-sectional view showing a condition of the valve timing control apparatus of the second embodiment wherein a stopper piston is pulled out of a stopper bore.

As shown in FIG. 10, upon selection of position 49*a* in switching valve 49 from the condition shown in FIG. 9, pressurized oil of pump 46 is fed to hydraulic chamber 23. By supplying pressurized oil into hydraulic chamber 23, stopper piston 50 is pulled out or disengaged from stopper bore 20.

FIGS. 9 and 10 respectively show the condition where vane rotor 9 is held at the most-retarded position with respect to shoe housing 3. Upon supply of pressurized oil into hydraulic chamber 23, the inside space of damper chamber 52 is filled with oil flowing through the coupling clearance between stopper piston 50 and guide ring 51.

To rotate vane rotor 9 in the advance direction with respect to shoe housing 3, switching valve 49 selects position 49*c* from the condition of FIG. 10. There is a slight time lag until the oil pressure of hydraulic chamber 24 reaches a predetermined level. Before elapsing this time lag, stopper piston 50 receiving a resilient force of spring 18 may shift toward stopper bore 20. However, when stopper piston 50 shifts towards stopper bore 20, the amount of oil discharged from damper chamber 52 through the coupling clearance is so limited. Hence, the shifting speed of stopper piston 50 toward stopper bore 20 is greatly reduced. In other words, damper chamber 52 acts as a damping means.

Accordingly, oil pressure in the hydraulic chamber 24 can reach the predetermined level well before stopper piston 50 is engaged with stopper bore 20. Thus, the hydraulic control of an advancing or retarding rotation of vane rotor 9 with respect to stopper piston 50 can be continued, without causing engagement between stopper piston 50 and stopper bore 20.

As described above, the second embodiment makes it possible to prevent stopper piston 50 is momently pulled into stopper bore 20 in the transition period where vane rotor 9 advances from the most-retarded position toward the advance side with respect to shoe housing 3.

As a possible modification for the first and second embodiments, it will be possible to establish a communication between hydraulic chamber 23 and advance hydraulic chambers 12, 13 and also between hydraulic chamber 24 and retard hydraulic chambers 10, 11, obtaining substantially the same effects.

Third Embodiment

Figure 11:
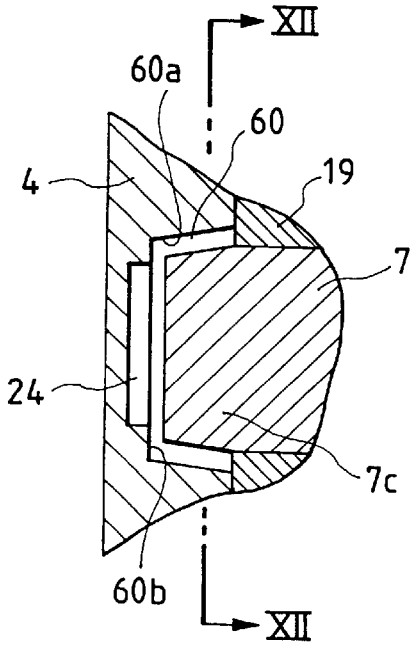
FIG. 11 is a cross-sectional view showing a coupling or engagement between a stopper pin and a stopper bore in accordance with a third embodiment of the present invention.

A third embodiment of the present invention will be explained with reference to FIGS. 11 and 12.

The third embodiment is substantially the same with the first embodiment except for the configuration of a stopper bore 60. FIG. 11 is a cross-sectional view, taken along the axis of cam shaft 2, showing a condition where stopper piston 7 is engaged with stopper bore 60. As apparent from FIG. 11, the outer tapered surface of stopper piston 7 is not brought into contact with the inner tapered surface of stopper bore 60. Instead, the outer tapered surface of stopper piston 7 abuts the inner tapered surface of stopper bore 60 at either side (i.e. near side or far side on the drawing).

Figure 12:
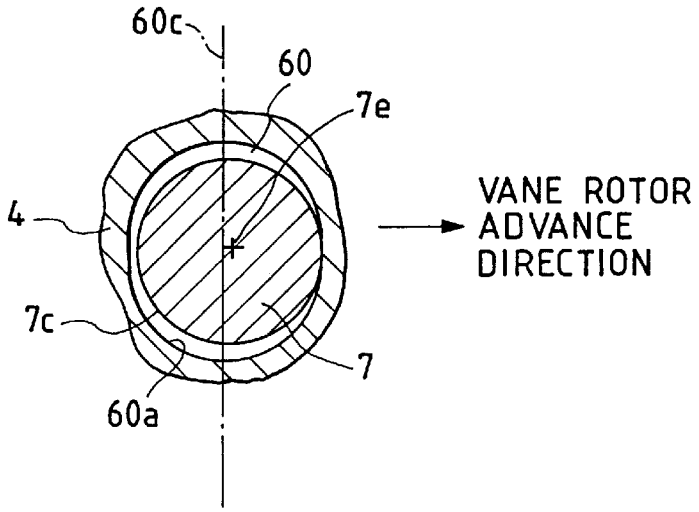
FIG. 12 is a cross-sectional view taken along a line XII—XII of FIG. 11.

More specifically, as shown in FIG. 12 stopper bore 60 has an elliptic vertical cross section elongated in the radial direction (up-and-down direction in FIG. 12). Namely, stopper bore 60 is a hole formed on front plate 4 so as to extend in the radial direction thereof. Thus, stopper bore 60 has a central axis 60*c* extending along the major axis thereof. The inner surface of stopper bore 60 is formed into a tapered surface.

Stopper piston 7, acting as a locking or engaging member, has front end portion 7*c* having a circular cross section whose diameter decreases with approaching the front end.

The inner surface of stopper bore 60 is tapered in the same direction and at the same angle as those of front end portion 7*c* of stopper piston 7, so as to maintain a predetermined gap between them.

The positional relationship between stopper piston 7 and stopper bore 60 is designed in the same manner as the first embodiment. Namely, when shoe housing 3 and vane rotor 9 are held in the most-retarded position (i.e. restricting position), these parts 7 and 60 are mutually pressed. Hence, shoe housing 3 and vane rotor 9 can be firmly fixed or restrained.

Furthermore, forming stopper bore 60 elongated in the radial direction is effective to keep sufficient clearance between stopper piston 7 and stopper bore 60 in the radial direction, thereby preventing front plate 4 from being urged by the engagement of tapered surfaces when stopper piston 7 is engaged with stopper bore 60. It is effective to prevent an offset force is applied on the sliding portion between front plate 4 and cylindrical protrusion 5. In other words, it becomes possible to design a very small clearance between front plate 4 and cylindrical protrusion 5, without causing frictional damage thereon.

In the same manner, it becomes possible to prevent the vane member including vane rotor 9 from causing a radial dislocation with respect to the housing member including front plate 4, preventing frictional damage and sealing deterioration.

As described above, the third embodiment of the present invention provides a radially elongated stopper bore 60 so that the circular stopper piston 7 can be brought into contact with stopper bore 60 only the surfaces opposing in the rotational direction of vane rotor 9 so as to firmly fix the housing member with the vane member, while preventing an undesirable force from transmitting therebetween in the radial direction. Hence, it becomes possible to align the housing member and the vane member coaxially, while firmly fixing or restraining the housing member with the vane member.

Fourth Embodiment

A fourth embodiment of the present invention will be explained with reference to FIGS. 13 and 14.

The fourth embodiment is different from the first embodiment in the drain arrangement. More specifically, compared with the drain hole 21 of the first embodiment opened on the side wall of vane 9*a* and extending toward chain sprocket 1, a drain hole 71 of the first embodiment is opened on the outer cylindrical wall of vane 9*a* and extends from accommodation hole 8 toward shoe housing 3. Furthermore, compared with the atmospheric hole 22 of the first embodiment opened on chain sprocket 1, an atmospheric hole 72 of the fourth embodiment is opened through the cylindrical wall of the shoe housing 3.

Drain hole 71 of vane 9*a* meets atmospheric hole 72 of shoe housing 3 when vane rotor 9 is in the most-retarded position. Hence, the space 8*a* behind stopper piston 7 accommodating spring 18 therein is maintained at an atmospheric pressure through communication of drain hole 71 and atmospheric hole 62.

Figure 13:
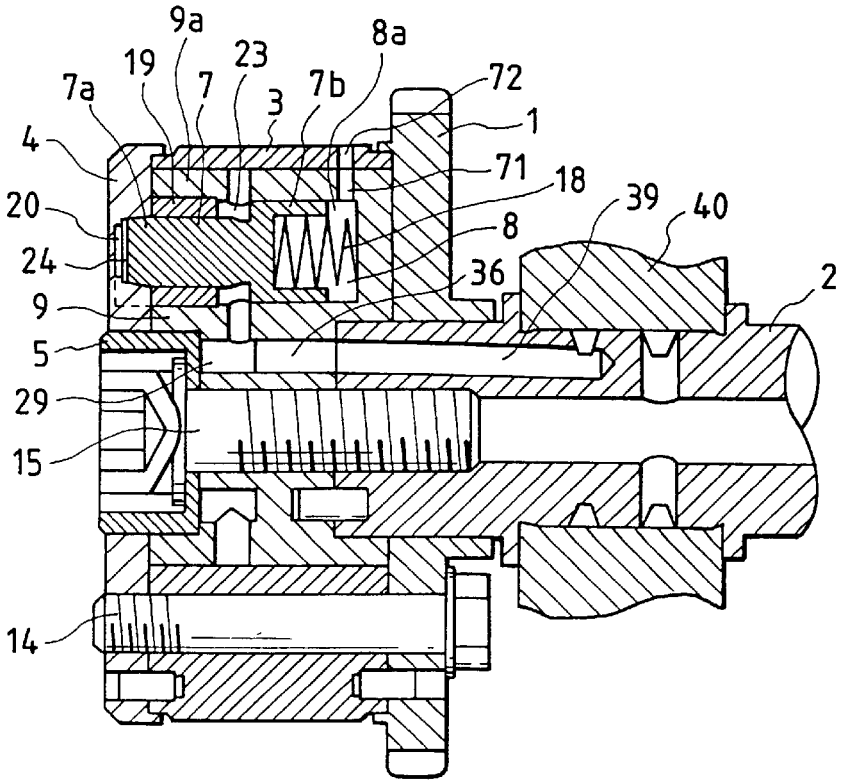
FIG. 13 is a vertical cross-sectional view showing a valve timing control apparatus in accordance with a fourth embodiment of the present invention.

The volume of the space (back-pressure chamber) 8*a* decreases when stopper piston 7 shifts right in FIG. 13 (i.e. restraint release direction between shoe housing 3 and vane rotor 9). The volume of space 8*a* increases when stopper piston 7 shifts left in FIG. 13 (i.e. restraint direction between shoe housing 3 and vane rotor 9).

When vane rotor 9 is held in the most-retarded position with respect to shoe housing 3 and no pressurized oil is supplied into hydraulic chambers 23 and 24, stopper piston 7 is engaged with stopper bore 20 as shown in FIG. 13. In this condition, drain hole 71 meets atmospheric hole 72.

Figure 14:
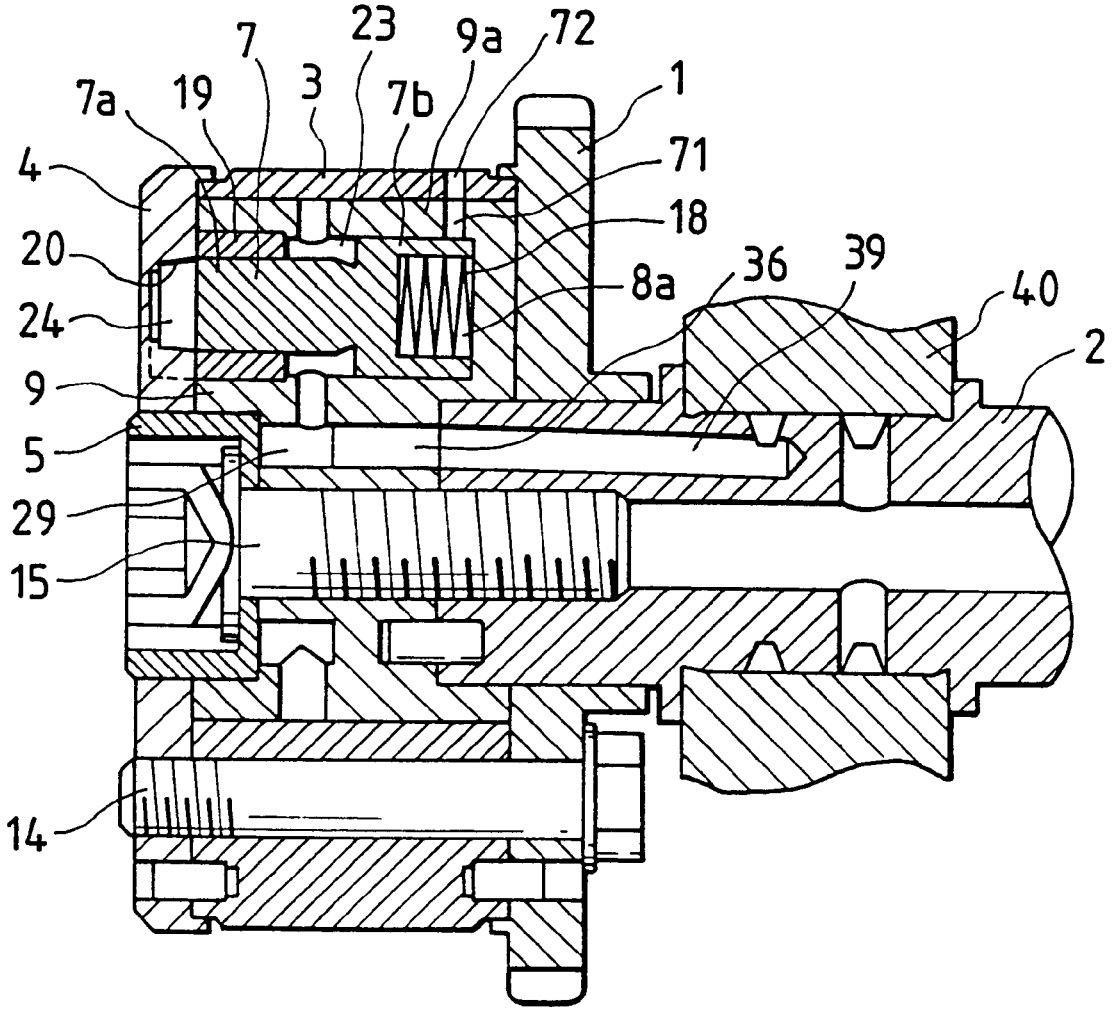
FIG. 14 is a vertical cross-sectional view showing a condition of the valve timing control apparatus of the fourth embodiment wherein a stopper piston is pulled out of a stopper bore.

Once pressurized oil is supplied into hydraulic chamber 23 from the condition of FIG. 13, stopper piston 7 is pulled out or disengaged from stopper bore 20 as shown in FIG. 14. In this condition, drain hole 71 is closed by the outer wall of larger-diameter portion 7*b*. Hence, back-pressure chamber 8*a* is disconnected from atmosphere. FIGS. 13 and 14 show the conditions where vane rotor 9 is most-retarded with respect to shoe housing 3.

Upon switching of a switching valve (not shown but substantially identical with switching valve 49 of the first embodiment), vane rotor 9 is rotated in the advance direction with respect to shoe housing 3 from the condition shown in FIG. 14. In this case, there is a slight time lag until the oil pressure of hydraulic chamber 24 reaches a predetermined level. Before passage of this time lag, stopper piston 7 receiving a resilient force of spring 18 may shift toward stopper bore 20. However, back-pressure chamber 8*a* is closed when stopper piston 7 shifts toward stopper bore 20. The amount of oil flowing through the coupling clearance is so limited. Hence, the shifting speed of stopper piston 7 toward stopper bore 20 is greatly reduced. In other words, back-pressure chamber 8*a* acts as a damping means.

Accordingly, oil pressure in the hydraulic chamber 24 can reach the predetermined level well before stopper piston 7 is engaged with stopper bore 20. Thus, the hydraulic control of an advancing rotation of vane rotor 9 with respect to shoe housing 3 can be initiated, without causing engagement between stopper piston 7 and stopper bore 20.

Fifth Embodiment

A fifth embodiment of the present invention will be explained with reference to FIGS. 13 through 18. In this fifth embodiment, there is provided a gear 61 instead of chain sprocket 1 of the first embodiment. A cam shaft 62 is hence driven by gears.

Figure 15:
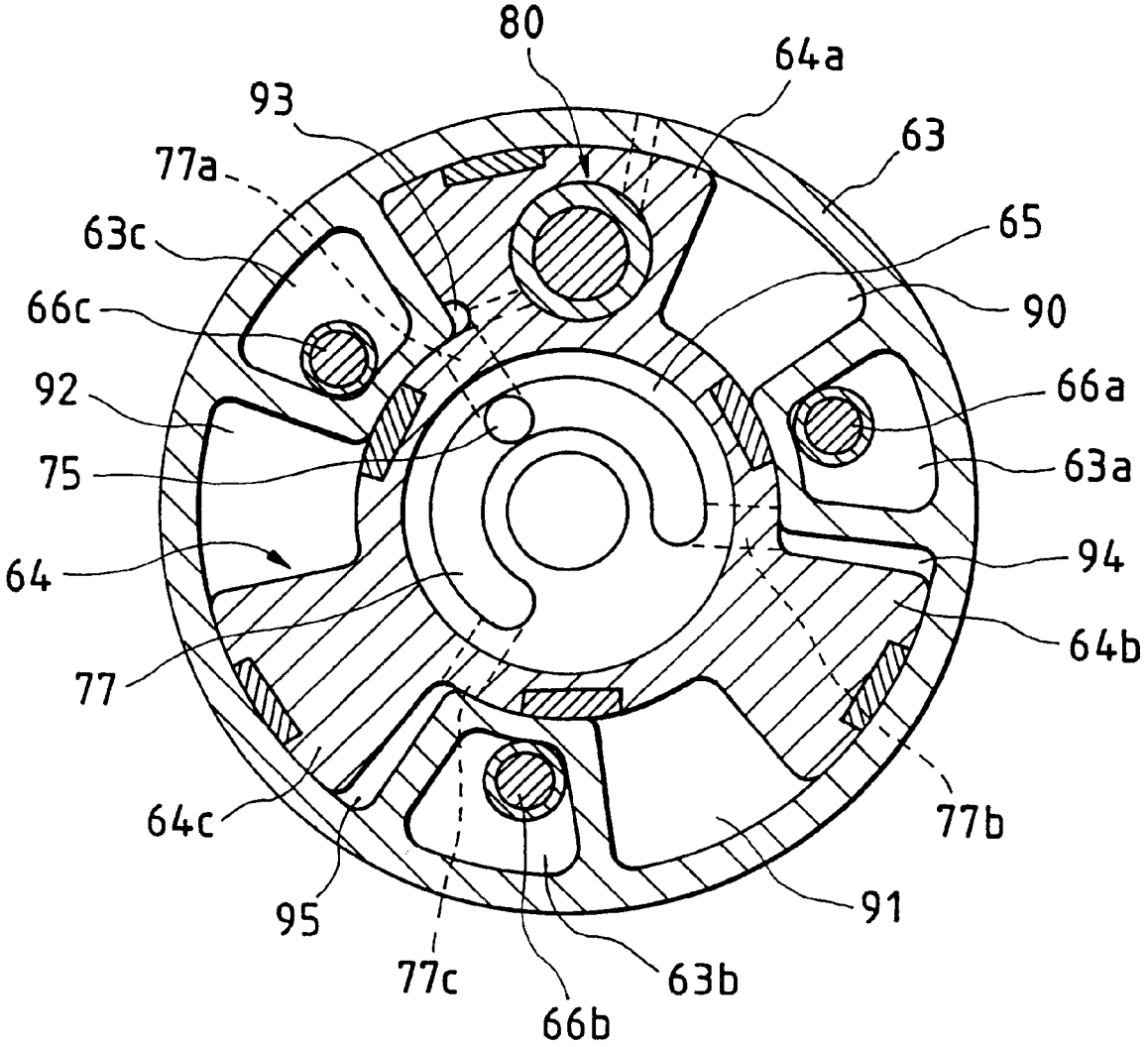
FIG. 15 is a transverse cross-sectional view showing an arrangement of a valve timing control apparatus in accordance with a fifth embodiment of the present invention, taken along a line XV—XV of FIG. 17.
Figure 16:
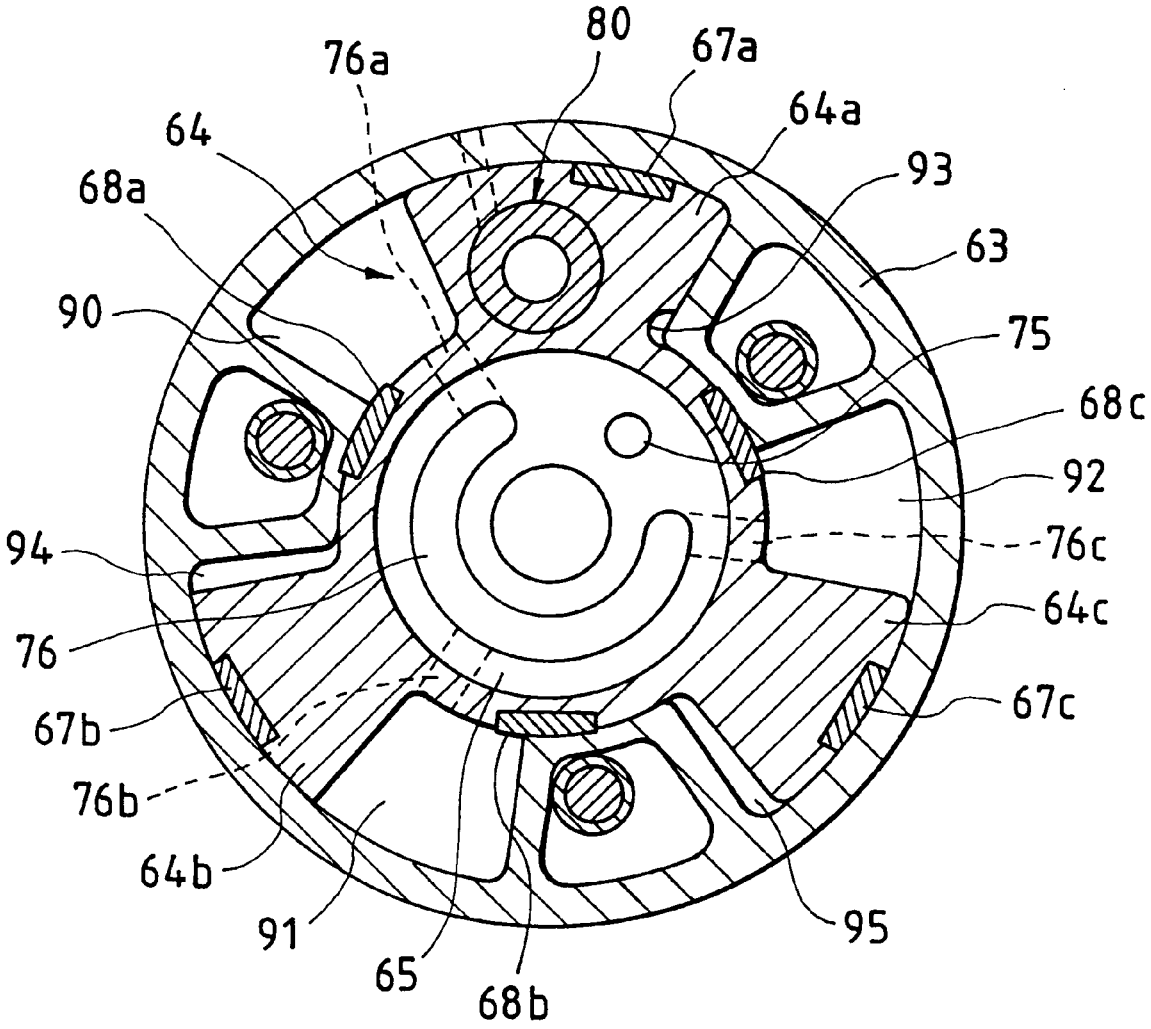
FIG. 16 is a transverse cross-sectional view taken along a line XVI—XVI of FIG. 17.

As shown in FIGS. 15 and 16, a shoe housing 63 comprises a total of three trapezoidal shoes 63*a*, 63*b* and 63*c* equally spaced in the circumferential direction along the cylindrical wall thereof. The front end of shoe housing 63 is closed by front plate 4, while rear end of shoe housing 63 is closed by gear 61 serving as a rear plate. Three trapezoidal shoes 63*a*, 63*b* and 63*c* have hollow spaces into which bolts 66*a*, 66*b* and 66*c* are inserted for fixing all the housing component members 4, 63 and 61.

Three circumferential gaps, one defined between shows 63*c* and 63*a*, second between 63*a* and 63*b*, and third between 63*b* and 63*c*, are sector spaces serving as accommodation chambers for three vanes 64*a*, 64*b* and 64*c*, respectively.

A vane rotor 64 comprises a cylindrical boss 65, and three vanes 64*a*, 64*b* and 64*c* integrally formed with cylindrical boss 65 and extending in radial directions. Vanes 64*a*, 64*b* and 64*c* are disposed at equal intervals (angles) in the circumferential direction, and are rotatably accommodated in sector spaces defined by shoes 63*a*, 63*b* and 63*c* along the cylindrical wall of shoe housing 63.

A first retard hydraulic chamber 90 is defined between shoe 63*a* and vane 64*a*. A second retard hydraulic chamber 91 is defined between shoe 63*b* and vane 64*b*. And, a third retard hydraulic chamber 92 is defined between shoe 63*c* and vane 64*c*.

A first advance hydraulic chamber 93 is defined between shoe 63*c* and vane 64*a*. A second advance hydraulic chamber 94 is defined between shoe 63*a* and vane 64*b*. A third advance hydraulic chamber 95 is defined between shoe 63*b* and vane 64*c*.

Vane 64*a* has a hole extending in the axial direction of cam shaft 62, for slidably accommodating a stopper piston 80 therein. Stopper piston 80 serves as a locking or connecting member.

Figure 17:
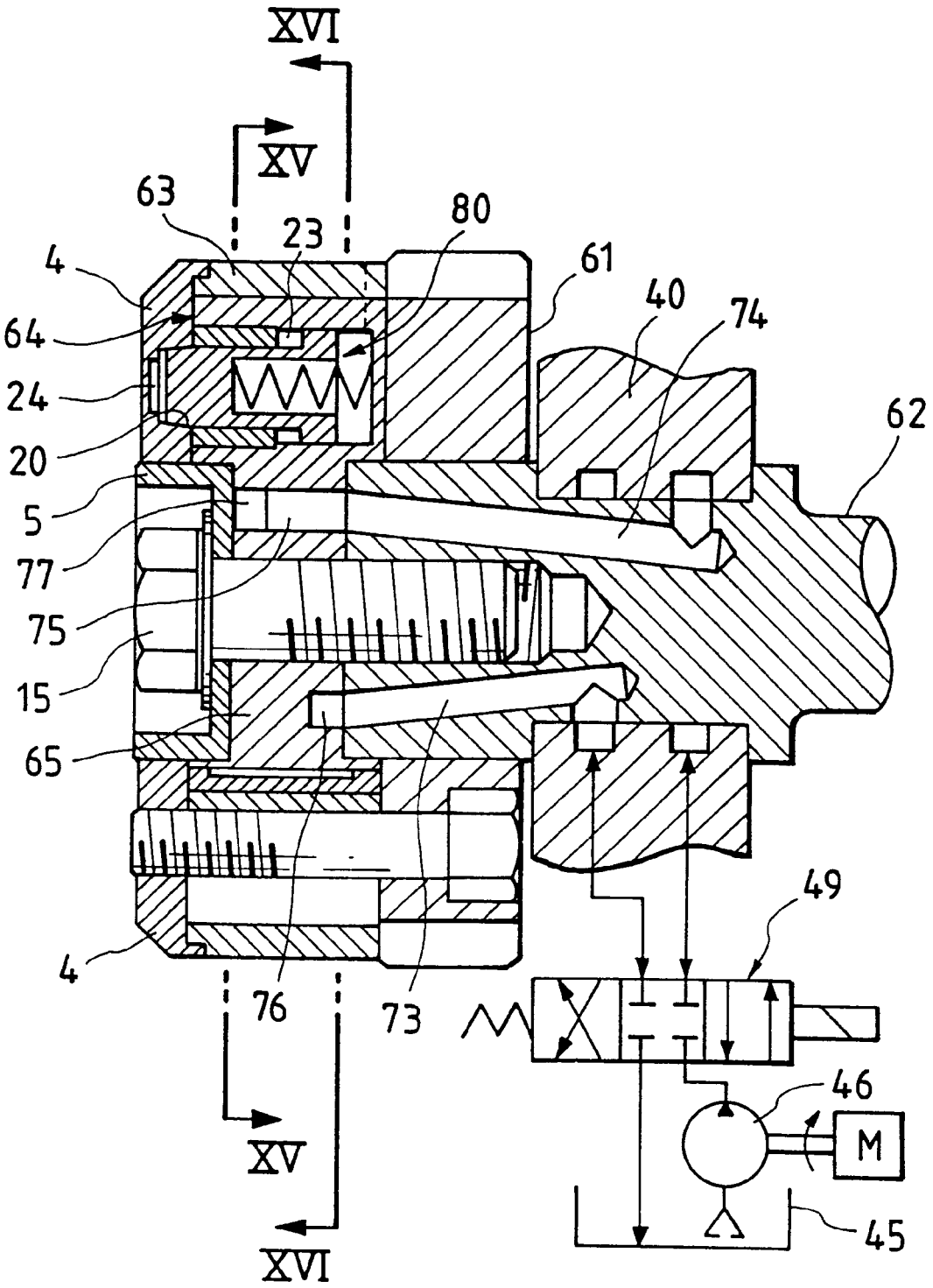
FIG. 17 is a vertical cross-sectional view showing an arrangement of the valve timing control apparatus in accordance with the fifth embodiment of the present invention.

As shown in FIGS. 15, 16 and 17, cylindrical boss 65 of vane rotor 64 is provided at its axial ends with two oil passages 76 and 77 configured into arc grooves offset in the circumferential direction. Oil passage 76 is defined between cylindrical boss 65 and cam shaft 62. The other oil passage 77 is defined between cylindrical boss 65 and cylindrical protrusion 5.

Figure 18:
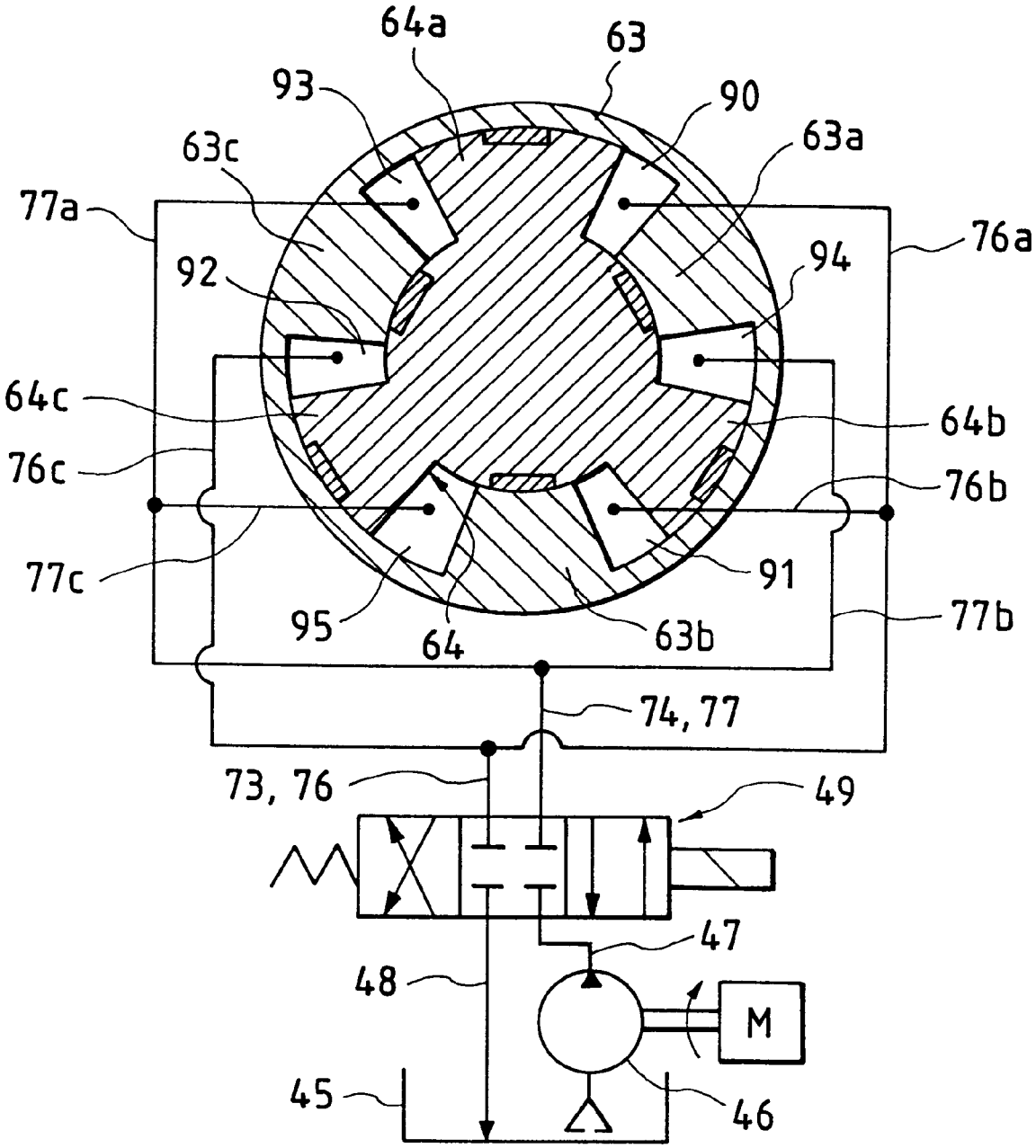
FIG. 18 is a schematic view showing a hydraulic pressure control circuit in accordance with the fifth embodiment of the present invention.

As shown in FIG. 18, oil passage 76 is communicated with retard hydraulic chambers 90, 91 and 92 via oil passages 76*a*, 76*b* and 76*c*, respectively. Oil passage 77 is communicated with advance hydraulic chambers 93, 94 and 95 via oil passages 77*a*, 77*b* and 77*c*, respectively.

Oil passage 76 is communicated with an oil passage 73 formed in cam shaft 62 through the axial abutting surfaces of cylindrical boss 65 and cam shaft 62. An oil passage 75 is communicated with an oil passage 74 formed in cam shaft 62 through the axial abutting surfaces of cylindrical boss 65 and cam shaft 62. Oil passage 77 is communicated with this oil passage 75 through axial abutting surfaces of cylindrical boss 65 and cylindrical protrusion 5.

Reference numerals 67*a*, 67*b*, 67*c*, 68*a*, 68*b* and 68*c* represent sealing members.

According to the fifth embodiment, providing three vanes 64*a*, 64*b* and 64*c* brings the following effect.

Under the condition where the pressure-receiving areas at circumferential both sides of each of vanes 64*a*, 64*b* and 64*c* are identical with the pressure-receiving areas at circumferential both sides of each of two vanes 9*a* and 9*b* of the first embodiment, vane rotor 64 can receive an increased force in the circumferential direction in proportion to the total pressure-receiving area. That is, the force acting from hydraulic chambers to the three-vane rotor 64 of the fifth embodiment is 3/2 times as large as the force acting from hydraulic chambers to the two-vane rotor 9 of the first embodiment.

In other words, when a hydraulic force for driving vane rotor 64 in the circumferential direction is only required to be as large as that of the first embodiment, it becomes possible to reduce the areas of the circumferential side surfaces of vanes 64*a*, 64*b* and 64*c*. Namely, it becomes possible to reduce the size of the vane rotor, reading to the realization of a compact valve timing control apparatus.

Miscellaneous Arrangements

Although the above-described embodiments disclose the stopper piston accommodated in the rotor and the engaging bore formed on the housing member, it is of course possible to accommodate the stopper piston in the housing and to form the engaging bore on the rotor.

Although the above-described embodiments provide the tapered surface on both the front end portion of the stopper piston and the stopper bore, it is possible to provide the tapered surface on only one of these two. For example, one of two is formed with the tapered surface while the other is formed with a spherical surface slidable on this tapered surface.

Furthermore, providing a slant surface is important or key to generate an urging force in the rotational direction by the wedge effect. Hence, it is desirable to provide the slant surface at least one side of the rotational direction (i.e. advance side) of the stopper bore.

Furthermore, the above-described embodiments provide stopper portion 9*e* brought into contact with shoe 3*a* at the most-retarded position as shown in FIG. 2, it is also possible to provide the stopper portion 9*e* at the left side of vane 9*a* in FIG. 2 so as to brought into contact with shoe 3*b* at the most-retarded position. It is possible, even by this arrangement, to obtain a force pressing vane rotor 9 to shoe housing 3 by the engagement of the stopper piston and the stopper bore.

Furthermore, it is also possible to provide a twin lock mechanism where the stopper piston and the stopper bores are brought into contact with each other at both the most-retarded position and the most-advanced position.

Although the above-described embodiments disclose the vanes integrally formed from the cylindrical boss, it is possible to form the vanes independent of the cylindrical boss.

Although the above-described embodiments disclose the vane rotors having two or three vanes, the number of vanes can be reduced to one or can be increased to four or more.

Although the stopper piston and the stopper bore are tapered at their confronting or engaging surfaces with the same taper angle, each taper angle can be differentiated as long as the stopper piston can be engaged or coupled with the stopper bore.

Although the above-described embodiments adopt the arrangement that the chain sprocket or the gear is rotated in synchronism with the crank shaft to rotate the shoe housing integral with the crank shaft while the vane rotor is integrally rotated with the cam shaft, it is also possible to adopt an arrangement that the chain sprocket is integrally rotated with the cam shaft while the vane rotor is integrally rotated with the crank shaft. In such a case, the vane rotor is connected at the most-advanced position to the shoe housing by means of the locking member.

The valve timing control apparatuses in accordance with the above-described embodiments can be applied to an internal combustion engine which has two parallel cam shafts independently used for opening or closing intake valves or exhaust valves. In such a twin cam-shaft engine, the valve timing control apparatus can be disposed between two cam shafts.

For example, one cam shaft is entrained by the crank shaft via a chain in synchronism with the rotation of the crank shaft. The other cam shaft is driven by the one cam shaft via a gear train. In this case, the vane rotor can be rotated together with the one cam shaft acting as a driving shaft, while the housing member can be rotated together with the other cam shaft acting as a driven shaft, or vice versa.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A rotational or angular phase control apparatus interposed between first and second rotational shafts for varying a rotational or angular phase between said first and second rotational shafts, said apparatus comprising:

a housing connected to said first rotational shaft and rotatable together with said first rotational shaft;

a rotor connected to said second rotational shaft and accommodated in said housing so as to cause a rotation within a predetermined angle with respect to said housing;

said rotor and said housing cooperatively defining a chamber whose volume is variable in accordance with a rotational position of said rotor with respect to said housing; and a lock mechanism for locking said rotor with said housing to restrict a rotational displacement of said rotor in said housing, in such a manner that said rotor is firmly engaged with said housing by said lock mechanism only when said rotor is brought into contact with said housing at one end of a rotational direction of said rotor, said rotor being disengaged from said housing when said rotor is positioned at other rotational positions, wherein said lock mechanism comprises a locking member provided in one of said housing and said rotor and an engaging portion provided in the other of said housing and said rotor, and an inclined surface is provided on at least one of said locking member and said engaging portion, said inclined surface being inclined with respect to an axis parallel to an axis of rotation of said rotor, said locking member being locked with said engaging portion and brought into contact with each other at said inclined surface, so that said locking member advances toward said engaging portion so as to cause a mutual rotational displacement between said rotor and said housing for pressing said rotor to said housing.

2. A rotational or angular phase control apparatus in accordance with claim 1, wherein said locking member comprises a pin provided in one of said housing and said rotor, said engaging portion is an engaging bore provided in the other of said housing and said rotor for receiving said pin; and wherein said inclined surface is a tapered surface provided on at least one of said pin and said engaging bore so that said pin and said engaging bore are brought into contact with each other at said tapered surface so that said rotor is firmly locked with said housing by a wedge effect caused by said tapered surface contact when said rotor is positioned at an end position of said rotational direction with respect to said housing.

3. The rotational or angular phase control apparatus in accordance with claim 2, wherein said engaging bore is an elongated bore extending in a direction parallel to said axis of rotation of said rotor.

4. The rotational or angular phase control apparatus in accordance with claim 1, wherein said engaging portion is an elongated bore extending in a direction parallel to said axis of rotation of said rotor.

5. The valve timing control apparatus in accordance with claim 1, wherein said first and second rotational shafts are a combination of a crank shaft and a cam shaft of an internal combustion engine, and said lock mechanism operates in such a manner that a valve timing of an intake valve driven by said cam shaft becomes preferable for an engine start-up operation when the rotor and the housing are fixed by the lock mechanism.

6. The valve timing control apparatus in accordance with claim 5, wherein said lock mechanism allows said rotor to be engaged with said housing only when said rotor is held in a predetermined most-retarded position.

* * * * *